US010457469B2

(12) United States Patent
Tumber et al.

(10) Patent No.: US 10,457,469 B2
(45) Date of Patent: Oct. 29, 2019

(54) INSULATED SHIPPING CONTAINER HAVING AT LEAST ONE SPACER FOR IMPROVING AIRFLOW WITHIN THE CONTAINER

(76) Inventors: James William Howard Tumber, Barrington, RI (US); Alton Williams, Miami, FL (US)

( * ) Notice: Subject to any disclaimer, the term of this patent is extended or adjusted under 35 U.S.C. 154(b) by 930 days.

(21) Appl. No.: 13/439,437

(22) Filed: Apr. 4, 2012

(65) Prior Publication Data

US 2012/0248101 A1 Oct. 4, 2012

Related U.S. Application Data

(63) Continuation-in-part of application No. 12/697,809, filed on Feb. 1, 2010, now Pat. No. 8,613,202, which (Continued)

(51) Int. Cl.
*F25D 3/00* (2006.01)
*B65D 81/38* (2006.01)
(Continued)

(52) U.S. Cl.
CPC ..... *B65D 81/3862* (2013.01); *B65D 81/05* (2013.01); *F25D 3/00* (2013.01); *F25D 3/08* (2013.01); *F25D 11/003* (2013.01); *F25D 2303/00* (2013.01); *F25D 2303/081* (2013.01); *F25D 2303/082* (2013.01); *F25D 2303/084* (2013.01); *F25D 2303/0821* (2013.01); *F25D 2303/0822* (2013.01); *F25D 2303/0832* (2013.01); *F25D 2303/0843* (2013.01); (Continued)

(58) Field of Classification Search
CPC .... F25D 3/00; F25D 2400/01; F25D 2303/00; F25D 2303/08–08223; F25D 11/003; F25D 2303/0832; F25D 2303/0843; F25D 2303/084
USPC ..... 62/457.2, 457.1, 406; 220/592.05, 592.2, 220/592.03
See application file for complete search history.

(56) References Cited

U.S. PATENT DOCUMENTS 652,492 A 6/1900 Stuart
1,579,014 A * 3/1926 Maertz ..... 220/592.03
(Continued)

OTHER PUBLICATIONS

Brochure entitled "THERMOshipping by STOROpack" 2010 from http://www.storopack.com/fileadmin/user_upload/6_Download/Brochers/Thermoshipping_english_2010_mail.pdf.

*Primary Examiner* — David J Teitelbaum
(74) *Attorney, Agent, or Firm* — Kristina Castellano; Castellano PLLC

(57) ABSTRACT

Shipping container systems are provided for shipping a temperature sensitive product or payload. The systems include at least one heat transfer element and a payload container configured to hold payload therein and configured to be positioned within a shipping container; the payload container being spaced from sidewalls of the shipping container. Also included are spacers that may for example, space the payload container from one or more of the heat transfer elements. The spacers are configured to allow air to flow over surfaces of the payload container and heat transfer elements. Also included are kits that include components of the system and methods. Further provided are products that include any one or more of the described elements; and fully assembled shipping containers.

23 Claims, 11 Drawing Sheets

Related U.S. Application Data is a continuation of application No. 11/105,541, filed on Apr. 14, 2005, now Pat. No. 7,681,405.

(60) Provisional application No. 61/471,693, filed on Apr. 4, 2011.

(51) Int. Cl.
*B65D 81/05* (2006.01)
*F25D 3/08* (2006.01)
*F25D 11/00* (2006.01)

(52) U.S. Cl.
CPC ..... *F25D 2303/0844* (2013.01); *F25D 2303/08221* (2013.01); *F25D 2303/08222* (2013.01); *F25D 2303/08223* (2013.01); *F25D 2331/804* (2013.01); *F25D 2400/12* (2013.01)

(56) References Cited

U.S. PATENT DOCUMENTS 2,289,060 A 7/1942 Merkle
2,632,311 A 3/1953 Sullivan
3,410,109 A 11/1968 Maryland
4,145,895 A 3/1979 Hjertstrand et al.
4,294,079 A 10/1981 Benson
4,576,017 A * 3/1986 Combs ..... F25D 3/125 62/372
4,845,957 A 7/1989 Richardson
4,862,674 A 9/1989 Lejondahl et al.
4,903,493 A 2/1990 Van Iperen et al.
5,355,684 A 10/1994 Guice
5,417,082 A 5/1995 Foster et al.
5,435,142 A 7/1995 Silber
5,598,943 A * 2/1997 Markus ..... 220/592.03
5,669,233 A 9/1997 Cook et al.
5,697,500 A 12/1997 Walker
5,897,017 A 4/1999 Lantz
5,899,088 A * 5/1999 Purdum ..... B65D 81/056 62/371
5,924,302 A 7/1999 Derifield
5,983,661 A 11/1999 Wiesman
6,003,706 A 12/1999 Rosen
6,189,330 B1 2/2001 Retallick et al.
6,209,343 B1 4/2001 Owen
6,295,830 B1 * 10/2001 Newman ..... B65D 81/3823 62/371
6,381,981 B1 * 5/2002 Yaddgo et al. ..... 62/372
6,666,032 B1 12/2003 Rickson et al.
6,968,711 B2 11/2005 Smith et al.
8,613,202 B2 12/2013 Williams
2003/0217948 A1 * 11/2003 Lantz ..... B65D 5/48038 206/591
2005/0006272 A1 1/2005 Derifield
2006/0191282 A1 8/2006 Sekiya
2006/0230778 A1 10/2006 Williams
2013/0200083 A1 8/2013 Cunningham
2014/0083650 A1 3/2014 Ahmed

* cited by examiner

INSULATED SHIPPING CONTAINER HAVING AT LEAST ONE SPACER FOR IMPROVING AIRFLOW WITHIN THE CONTAINER

RELATED APPLICATION

This application is a continuation-in-part of U.S. patent application Ser. No. 12/697,809, filed on Feb. 1, 2010 now U.S. Pat. No. 8,613,202, which is a continuation application of U.S. patent application Ser. No. 11/105,541, filed on Apr. 14, 2005, now U.S. Pat. No. 7,681,405; and this application also claims the benefit of U.S. Provisional Application No. 61/471,693 filed on Apr. 4, 2011; the entire contents of each of which are hereby incorporated herein by reference in their entireties.

FIELD

The present invention generally relates to shipping containers (SC) for shipping temperature sensitive goods, and SC systems that include components to be positioned within a SC in various configurations for superior payload temperature management. Also included are products to individual components described herein, and groups of components, such as in a fully assembled SC. Further included are kits that include components to be positioned within the SC, and methods relating to the same.

BACKGROUND

Temperature sensitive goods/products are generally transported through logistics channels in shipping containers that are constructed using insulated materials and heat transfer elements (HTE). These temperature sensitive products include high-value foodstuffs, live cultures, laboratory samples, raw materials and biological products such as blood products, testing reagents, vaccines and a variety of biopharmaceuticals that treat hormone deficiencies, virus infections and cancers. In particular, biological products have storage conditions that are registered with the Federal Drug Administration (FDA), the U.S. Department of Agriculture (USDA) and other domestic and foreign regulatory agencies. Regulatory agencies oversee the safe transport of temperature sensitive products to ensure these products' diagnostic accuracy and therapeutic viability.

In recent years, regulatory agencies have increased their enforcement of regulations concerning the safe transport of temperature sensitive products. Accordingly, shippers of temperature sensitive products have had to verify the performance of their SC systems and many have had to make costly improvements to their SC systems to ensure compliance with these regulations.

SC systems generally use insulating materials to isolate payload from ambient temperature conditions. Insulating materials are materials that have relatively high heat resistance values, or R-values. Typical insulating materials found in SCs are expanded polystyrene foam (EPS), polyurethane foams (PU) and vacuum insulated panels (VIP). Less typically, other materials are used that are generally not thought of as insulating, but which have high R-values; materials like corrugated paperboard, bubble wrap, wood, cellulous pulp, fiberboard and the like. It should be noted here that all materials, including conducting materials, resist the transfer of heat, and therefore all materials have an R-value and could play a limited insulative role in the heat transfer processes discussed herein.

Thermal insulation is used in the construction of SCs to isolate payloads from ambient conditions, while HTEs are used within a closed SC system to regulate the transfer of heat from the payload. HTEs most typically used include ice, dry ice, gel packs, foam refrigerant, endothermic phase change materials, exothermic phase change materials and the like.

Conventional passive container systems transfer heat by conduction between HTEs and the payload. Conduction is a direct heat transfer method that relies on direct contact between the surfaces of two bodies with differing temperatures. In many conduction-based heat transfer systems insulating materials, or buffering materials, are placed between the HTE and the payload. Buffering materials may typically include chilled secondary HTE or a variety of insulating materials or both. Buffering materials function by resisting the transfer of heat, which reduces the efficiency of the heat transfer process. The primary HTE thus buffered now forms a less efficient heat transfer system that will transfer heat directly by conduction through the buffering materials.

Preferred payload temperature is adjusted in typical conduction-based heat transfer systems by adjusting the surface-to-surface contact between the payload and the buffering materials, and by adjusting the surface-to-surface contact between the buffering materials and the HTE. Shipping duration is adjusted in typical conduction-based heat transfer systems by adjusting the mass and composition of HTE, and adjusting the R-value of both the buffering materials and the SC materials.

In better conduction-based systems the phasing temperature of the HTE is precisely calibrated to match the preferred payload temperature, allowing the HTE to be in direct contact with the payload without a buffering material between. These improved HTEs are generally much more expensive per pound than conventional HTEs, generally absorb less heat than conventional HTEs, generally require expensive high-performance SC insulations, and generally require a larger HTE mass, all of which adds weight, cost and complexity to the SC systems and generally returns limited performance and duration improvements.

When smaller payloads are shipped in conduction-based SC systems the payload surface area available for surface-to-surface-contact is limited, and so the heat transfer system is typically placed above and/or below the payload in contact with a single payload surface. This configuration supplies uneven heat transfer due to the limited contact between the heat transfer system and the payload. When larger payloads are shipped in conduction-based SC systems the payload surface area available for surface-to-surface contact is more generous, and so the heat transfer system can be expanded across additional payload surfaces. This configuration supplies greater, more even heat transfer due to the greater contact between the heat transfer system and the payload. However, the corresponding increase in HTE and/or buffering materials required to increase the contact between the heat transfer system and the payload adds weight, complexity and cost to the SC system. As complexity and weight increase so too does the risk that the HTE and buffering materials in the heat transfer system will dislodge and migrate during shipment causing the heat transfer system to become unbalanced resulting in system failure.

Recent attempts to improve SC system design have been met with mixed success. In one example, a SC is disclosed whereby refrigerant is placed on a tray, separate from the payload. See, e.g. U.S. Pat. No. 4,576,017 to Combs et al., incorporated herein by reference. While '017 attempts to minimize the problems associated with putting buffered refrigerant in direct contact with the payload, the refrigerant tray itself has an R-value and acts as a buffering material through which heat must transfer by conduction, making the heat transfer process inefficient. In practical terms, to compensate for the reduced efficiency introduced by the refrigerant tray's resistance, '017 requires the use of more refrigerant to achieve equivalent efficiency to that of a SC system that does not include a refrigerant tray.

The '017 patent also discloses grooves or channels or protrusions that attempt to increase the air flow around the payload. However, the placement of these structures provide sufficient contact between the surface area of the payload and the surface area of the structures themselves, deleteriously reducing air flow around critical parts of the payload, leading to uneven cooling of the payload, especially around the base or bottom of the payload. Furthermore these designs continue to be costly, are difficult to construct, are not scalable, and do not lend themselves to pre-packaging or automated packaging.

SUMMARY

The present inventors believe that future SC systems must perform more efficiently using less expensive conventional materials that are arranged in ways that will improve performance and duration, reduce cost, and comply with regulations.

The present embodiments provide improved SCs and systems that are cost effective, scalable, and workable solutions demanded by the extreme requirements of shipping temperature sensitive products.

The present invention relates to SC systems, and more particularly insulated SC systems that may be used to ship temperature sensitive goods and products. The present invention also relates to kits that include SC system components, and methods of assembling, packing, and shipping goods and products in SCs. The present invention also relates to products that include any one or more of the components described herein, such as the unique horizontal spacers (shuttles) set forth herein. Further included are products that include an entire SC having one or more of the described components therein, which products may also include the payload.

BRIEF DESCRIPTION OF THE DRAWINGS

The features and advantages of the invention will be made clearer by the following detailed description of preferred, but non-exclusive, exemplary embodiments of the invention, illustrated, for the purposes of guidance and without restrictive intent, with reference to the attached drawings, in which.

DETAILED DESCRIPTION

Figure 1:
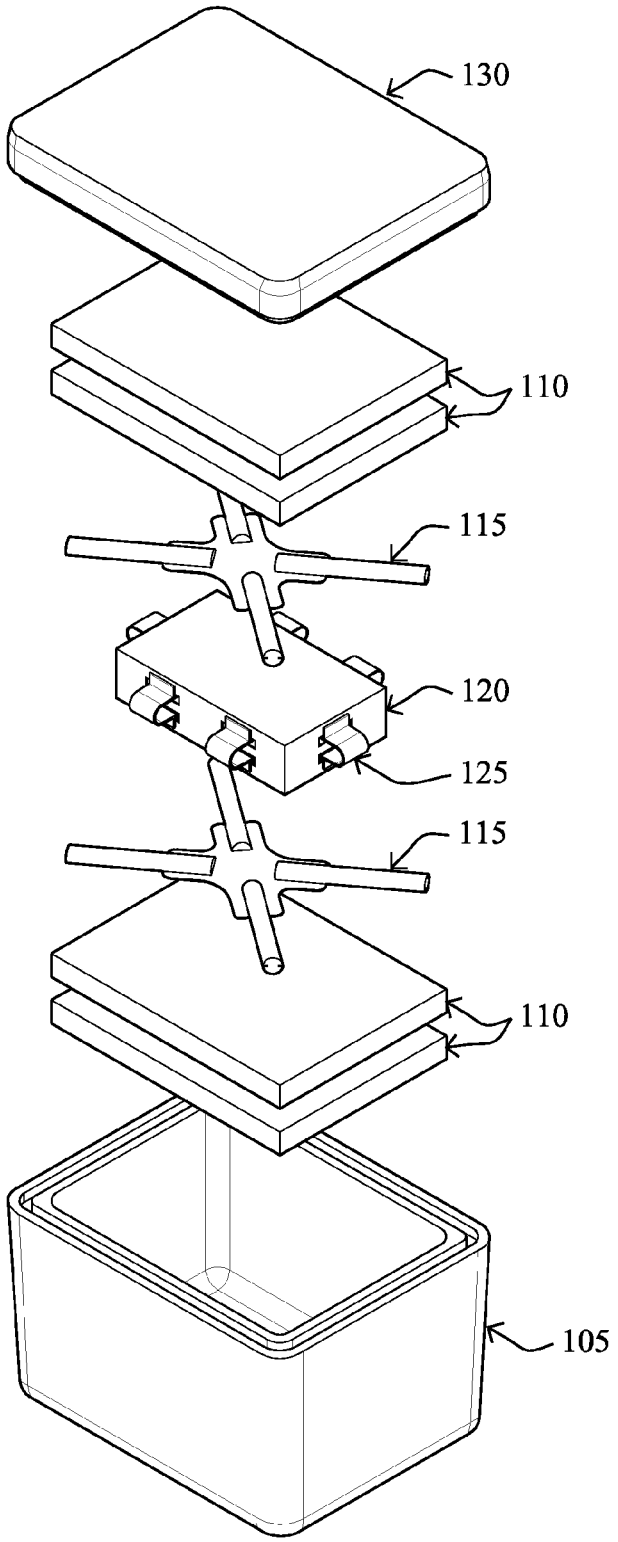
FIG. 1 depicts an exploded perspective view of a primary configuration of non-limiting embodiments of a system according to example embodiments of the present invention, in which spacers are placed between a payload container and HTEs.

The aspects, advantages and/or other features of example embodiments of the present disclosure will become apparent in view of the following detailed description, taken in conjunction with the accompanying drawings. The following detailed description of the invention is not intended to be illustrative of all embodiments.

The present application provides various embodiments of SC systems for shipping temperature sensitive goods that include various components or elements to be positioned within a SC in various configurations for superior temperature management of the goods/payload. Also included are kits and products that include components to be positioned within the SC, and methods relating to the same, such as methods for packing a payload or payload container in a SC using such components and systems to improve temperature management of the goods/payload.

In describing example embodiments, specific terminology is employed for the sake of clarity. However, the example embodiments are not intended to be limited to this specific terminology. It is to be understood that each specific element includes all technical equivalents that operate in a similar manner to accomplish a similar purpose. Unless otherwise noted, technical terms are used according to conventional usage. All patents and publications mentioned in this specification are indicative of the level of those skilled in the art to which the invention pertains. All publications, patent applications, patents and other references mentioned herein are incorporated by reference in their entirety.

As used herein, "a" or "an" may mean one or more. As used herein, "another" may mean at least a second or more. Furthermore, unless otherwise required by context, singular terms include pluralities and plural terms include the singular.

As used herein the term "and/or" includes any and all combinations of one or more of the associated listed items.

It will be understood that when an element is referred to as being "adjacent to" or "on" another element, it can be directly adjacent to or on the other element or intervening elements may be present. In contrast, when an element is referred to as being "directly adjacent to" or "directly on" another element, there are no intervening elements present. Other words used to describe the relationship between elements or layers should be interpreted in a like fashion (e.g., "between" versus "directly between," "connected" versus "directly connected," "coupled" to versus "directly coupled" to).

Spatially relative terms, such as "beneath," "below," "under," "lower," "above," "upper", "over" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

With reference to the described and depicted Figures, like numbers indicate like elements throughout.

The systems, kits, products, and methods provided herein generally use various components or elements to be included in, or part of, a SC, which components may be arranged in various ways to keep a payload/product temperature regulated, e.g., by transferring heat between the payload and the HTE using the air-filled space surrounding the payload container and at least one HTE (e.g., a refrigerant).

Embodiments of the present invention use heat transfer principles, i.e., convection and conduction depending on the design, in unique and novel ways, resulting in certain advantages including the ability to use less HTE per payload volume or payload weight, allowing shippers to increase the amount of payload being shipped. In addition, the design and methods of the present invention may reduce the overall weight of the container system, allowing shippers to reduce the cost of payload being shipped. The design and methods of the present invention also lead to increased uniformity in the cooling or warming of the payload. The present invention also provides for the use of single state HTEs.

Embodiments of the present invention provide for simple construction, increasing shipping efficiency and desirability of the system. The present systems and methods may lend themselves to use in automated and manual distribution processes. The present systems, kits, products, and methods may additionally provide advantages in the ability to prepack payload and HTEs in separate phases of a distribution process and allows shippers to use a variety of different HTE types and sizes. Additionally, the present systems, kits, products, and methods may reduce ineffective migration of payload and HTEs.

The present invention contemplates flexibly regulating payload temperature by varying the HTE phasing temperature and/or varying the surface areas of the HTE and the payload to improve and regulate system efficiency. The present systems may increase cooling efficiency and allow higher minimum operating HTE temperatures, which in turn reduces costs, risks of failure, and improves uniform cooling. This aspect of the invention may reduce design, development and implementation cost.

In alternative embodiments, the payload may be kept warm or cool (if desired) by using either exothermic or endothermic HTEs.

Non-limiting example embodiments of the present invention include systems that include a payload container, at least one HTE, and at least first and second spacers on opposite sides of the payload container. According to non-limiting example embodiments, the payload container has at least a first face, and a second face on an opposite side of the payload container from said first face, and the payload container is configured to be positioned within and spaced from inside sidewalls of a SC. In these embodiments, the at least one HTE is configured to be positioned adjacent to the first face of the payload container when the payload container and the HTE are positioned within the SC. Further in these embodiments, a first horizontal spacing element is configured to space the first face of the payload container from the at least one HTE, while allowing air to flow between the payload container and the HTE configured to be positioned adjacent thereto; and a second horizontal spacing element is configured to be positioned adjacent to the second face of the payload container (i.e., on the opposite side of the payload container from the first spacing element).

The payload container may be in various different shapes and/or sizes so long as it is configured to be able to hold a payload therein, and is configured such that it is smaller than the SC and able to fit therein. Although the embodiments depicted in the present figures include a payload container (120 in FIGS. 1-5, 230 in FIG. 6, and 330 in FIG. 7) having four sides, a top, and a bottom (referred to herein as first face and a second face herein), it is contemplated that the payload containers herein may have fewer sides (e.g., three sides or may be rounded and thus, only have one side), or more sides. The payload container may have curved or irregular shapes, or may have top and bottom faces that are not flat, but rather rounded or irregularly shaped. The shape of the payload container itself is not intended to be limited herein, but is to be selected for example, based on the payload to be shipped and/or based on packing considerations, such as ease of packing and the fit within a SC, or based on obtaining a desired surface area.

It is also contemplated that the "payload container" may simply be the outside of a payload itself without a further outside container holding the payload. Thus, the term "payload container" is meant to also encompass embodiments including a payload with no outer box or separate container per se.

According to non-limiting example embodiments, the payload container may have one or more holes therethrough and/or indents therein. So long as the proper spacing, air flow, and heat transfer concepts described herein are maintained, it should be understood that the payload container may be varied in many ways within the scope of the present application. Thus, reference herein to "side walls" and to "first and second faces" of the payload container is simply for purposes of orientation with respect to other components in the present systems, e.g., to be able to describe having HTEs over the payload container, or both over and under the payload container, e.g., adjacent to opposite first and second faces of the payload container. According to example embodiments in which a payload container may be e.g., spherical, conical, cylindrical, a bottle shape, or other shapes, it is contemplated that the first face and second face and/or the sidewalls of the payload container may not be separated or discreet from one another, but may be contiguous. Thus, it should be understood, as indicated above, that such language is used for general orientation with respect to which side of the payload container bumpers, spacing elements and/or HTEs are adjacent.

The present payload containers may, according to non-limiting example embodiments, include multiple payload containers, which may be e.g., stacked and/or side by side.

As used herein, the term "payload box" is used interchangeably with "payload container," and use of the term "box" should not be deemed as limiting with respect to the shape of the container, which as indicated above may be any shape.

The payload containers herein may be constructed of any material known to those skilled in the art. By way of non-limiting example, payload containers may be made of a cardboard material, plastic material, or combination thereof, or any other suitable material for containing goods.

Additionally, the present inventors have found that when the surface of a payload box is covered with a conducting material, such as foil or other metallic material, heat transfer transfers by conduction at the surface of the payload container. This evens out the heat transfer that is already occurring in the convective heat transfer system. According to non-limiting example embodiments, at least a portion of the payload container may be made of conducting materials, as in the case of a metal box, or foil may be laminated to a substrate, such as a corrugated material.

In further example embodiments, the payload may be surrounded with a water-filled bladder or a box lined with refrigerant bricks.

Contemplating their discovery that as ambient temperature approaches the target temperature for a payload in a closed free convection heat transfer system, the heat transfer process inside the closed free convection heat transfer system slows, thereby using less energy from the HTEs, and contemplating their discovery that larger SC systems transfer heat more efficiently than smaller SC systems, the present inventors discovered that when a smaller SC system (hereinafter referred to as a "payload system") is shipped within a larger/outer SC system, wherein the larger SC system holds temperature at or near the target payload temperature, the payload system conserves energy thereby extending its overall shipping duration by approximately the duration of the larger SC system. Additionally, once the payload system is removed from the larger SC system, the heat transfer system in payload system is triggered by ambient condition and has an additional shipping duration. This design allows bulk shipments of goods/products to be packed under controlled conditions at a primary shipping point, shipped over long distances to an intermediate shipping point, unpacked at the intermediate distribution point where it is them disassembled and distributed as individual payload systems to remote locations through "Last Mile" ambient conditions that neither the large SC system nor the payload system could reach on their own. The present inventors named this further embodiment the "Extended Duration Pod".

Figure 11:
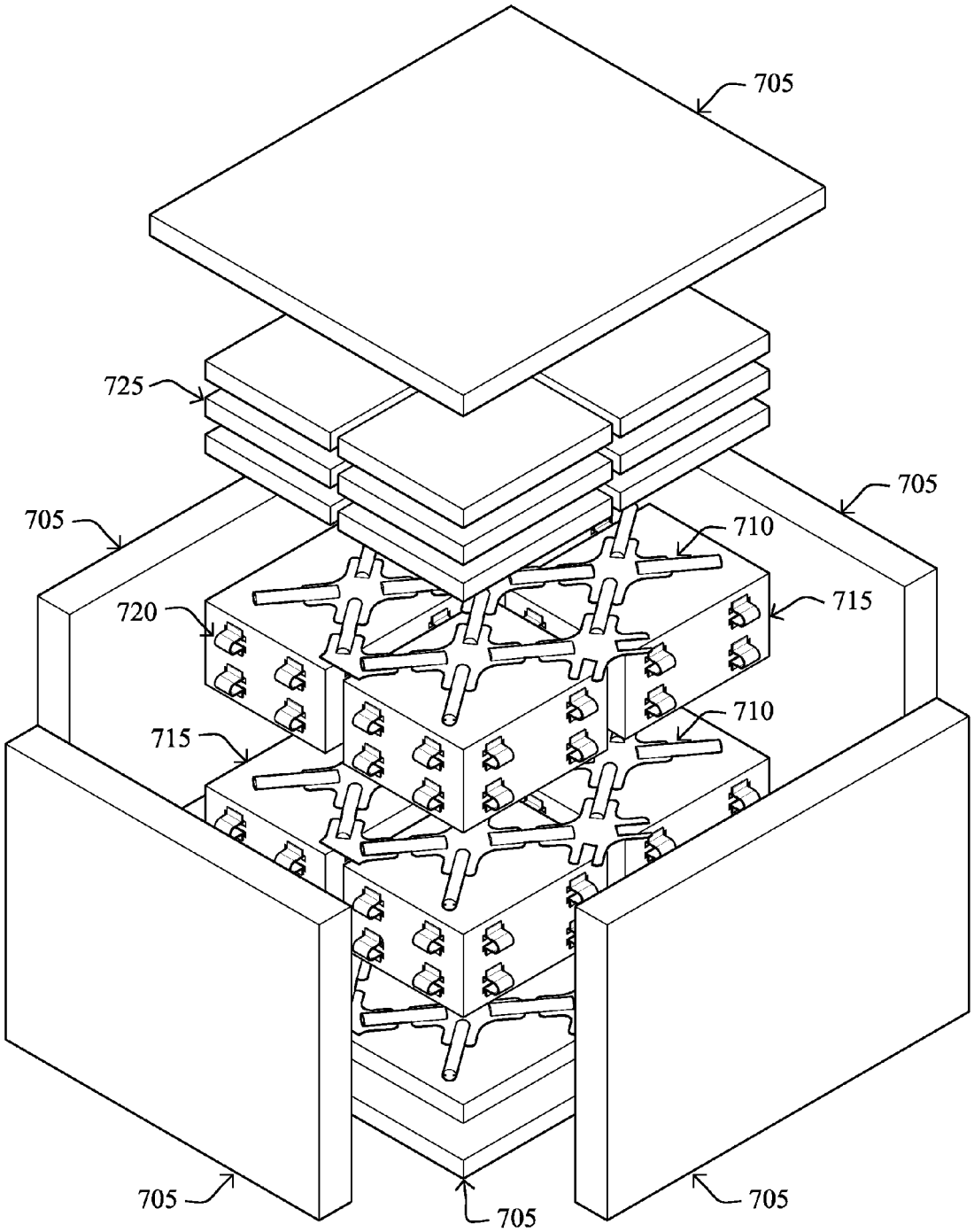
FIG. 11 depicts an exploded perspective view of an example configuration of a system according to non-limiting example embodiments of the present invention, in which secondary smaller SCs are positioned and configured as payload containers within a larger SC.

In example embodiments of the Extended Duration Pod, as depicted for example in FIG. 11, the Extended Duration Pod may be constructed e.g., using an insulated base pad (bottom component 705) cooperatively fit with at least one vertical insulated wall element (vertical side walls 705) to form a portion of an outer SC, such that a cavity is formed. At least one lower horizontal spacer is arranged to space at least one payload container/system 715 from the insulated base pad 705. The at least one payload container system 715 may be configured with at least one vertical spacer 720 on its exterior surface in the manner disclosed herein, such that a vertical airspace is maintained between at least one payload system and/or least one other adjacent payload system and/or the at least one vertical insulated wall element. As indicated herein with respect to other embodiments, the vertical spacers may alternatively be spacers that are part of or attached to inside walls of the outer SC, or they may be spacers that are independent of the SC and the payload container. At least one upper horizontal spacer 710 is configured and arranged above the at least one payload system 715, and at least one HTE 725 is configured and arranged above the at least one upper horizontal spacer. The system may then be closed with a lid 705.

In other embodiments of the Extended Duration Pod, the Extended Duration Pod may be constructed using an insulated base pad cooperatively fit with at least one vertical insulated wall element such that a cavity is formed. At least one lower horizontal spacer is arranged to space at least one payload system from the insulated base pad. The at least one payload system may be configured with at least one vertical spacer on its exterior surface (or as otherwise described herein) in the manner disclosed herein, such that a vertical airspace is maintained between the at least one payload system and/or at least one other adjacent payload system and/or the at least one vertical insulated wall element. At least one HTE is configured and arranged above the at least one payload system in contact with at least one surface of the at least one payload system. At least one upper horizontal spacer is configured and arranged above the HTE. The system may then be closed with a lid.

Thus, according to non-limiting embodiments, such as that depicted e.g., in FIG. 11, systems are provided herein which include at least one SC as described herein, which SCs 715 are configured to be positioned and configured within an outer SC 705, as a payload container. In example embodiments, the systems may further include at least one outer HTE 725 that may be placed above, or above and below and/or aside, the inner shipping container 715 (i.e., smaller SC system) of the present embodiments.

Also provided herein are kits and methods that utilize such systems. For example, example kits may include a fully constructed inside SC and outer components, such as an outer SC and/or heat transfer elements, and/or spacers to be utilized with the present systems and kits. Example kits may also include for example, instructions for loading an inner container within an outer container.

Example methods may include for example placing a fully assembled SC within an outer SC, as payload containers are described herein as being placed within a SC.

Further examples may include systems, kits and methods that may include a third or more SC, HTE, and payload container (e.g., there may be multiple fully assembled shipping containers 715 positioned and functioning as payload containers within an outer SC 705 as depicted for Example in FIG. 11). Alternatively, the third or more SC, payload container, etc. may refer to an envisioned embodiment in which the outer SC described above may be further nested within an even further outer SC. According to non-limiting example embodiments, the first/inner SC may positioned within a second/outer SC, and the second/outer SC may be further positioned within a third (or more)/even further outer SC.

It is further contemplated that the payload container may include airspace and/or cushioning and/or insulating and/or positioning elements within the container, as may be determined by one skilled in the art, depending for example, on the payload to be included therein.

The term "HTE" is intended to refer to for example a cooling element, such as a refrigerant (e.g., ice, dry ice, gel packs, foam refrigerant, endothermic phase change material, and the like) or a heating element (e.g., exothermic phase change material, and the like). The HTE may be any component whose purpose is to regulate or maintain the temperature of a payload being shipped. HTEs may be provided in various shapes, sizes and configurations, and may have for example, substantially flat surfaces and/or surfaces that are irregular or curved. HTEs may also have various indents or fenestrations extending partially or completely therethrough or other variations in shape for various purposes, such as for improved handling or packing. HTEs may be flexible or solid, although in certain embodiments it may be preferable to have a solid HTE to maintain a desired configuration and spacing in example embodiments of the present systems.

In an example embodiment, the HTE is rigid and can support its own weight, whether the HTE is in a solid, gel or liquid state. The various types of refrigerant that contain these properties are commonly known and used throughout the industry.

In alternative embodiments, discussed below, when the HTE is in direct contact with the payload container, a non-rigid HTE may not need the same amount or type of support as if it is suspended away from the payload container.

The present systems may be designed to include different HTEs; for example, where HTE used may be subject to physical degradation over time or where the HTE is not a rigid HTE, such as an ice filled plastic bag, or a gel filled refrigerant, supports or spacers may be used to maintain the HTE suspended above the payload.

According to non-limiting example embodiments, one or more HTEs may have one or more sides in direct contact with an inside surface of a SC. The present inventors have discovered that configuring and arranging HTEs such that at least one edge of at least one HTE is in direct contact with the interior of an SC allows for the arrangement and configuration within the SC of a maximum HTE mass without significantly restricting the fluid communication between significantly all the surface areas of a HTE and a payload container and air. This discovered advantage was unexpected. The inventors originally believed that both hot air was rising and cold air was falling, which implies that gravity and the density of cold air played a role in the air movement. However, the inventors unexpectedly found that hot air rising actually pushes or displaces the cold air downward and that even small cracks between the HTEs (e.g. refrigerants) and the cooler walls was sufficient to allow free movement around the HTE (unless the HTE is gasketed or sealed). Therefore, the present inventors discovered that contact between the HTE and the inside SC walls does not necessarily significantly obstruct required airflow and/or heat transfer in the system.

In determining which embodiments may have HTEs in contact with the interior of an SC, and how many sides would be in contact, the inventors considered the potentially limited volume available to arrange and configure payload containers, HTEs and horizontal and vertical spacers within an SC, and contemplating the dimensional irregularity of HTEs as they phase from a solid state to a gel or liquid state for example, during shipping time, and contemplated the dimensional variability of HTEs between solid and gel or liquid states. One skilled in the art having this information would be able to determine how many sides of which HTE to have in contact with the interior of a SC.

It has been found that by increasing the surface area of the payload and refrigerant exposed to the internal air filled space of the shipping system, increased cooling efficiency is achieved. According to non-limiting example embodiments, approximately at least 25% of the payload surface area is exposed to air. Similarly, in this embodiment approximately at least 25% of the HTE (e.g., refrigerant) surface area is exposed to air. According to further non-limiting example embodiments, approximately at least 50% of the payload surface area is exposed to air. Similarly, in this embodiment approximately at least 50% of the HTE surface area is exposed to air. While no specific limitation is intended by the recitation of the percent of surface area exposed to the air, it has been found that once approximately at least 25% of the surface area of either or both the payload and HTE surface area is exposed to the air, the shipping system displays cooling characteristics far superior to other passive heat transfer systems. In an example embodiment, at least 25% of the surface area of either or both the payload and HTE(s) may be exposed to the air. In further example embodiments, at least 50% of the surface area of either or both the payload and HTE(s) may be exposed to the air. In yet further example embodiments, at least 75% of the surface area of either or both the payload and HTE(s) may be exposed to the air. Further embodiments may include at least 85% of the surface area of either or both the payload and refrigerant is exposed to the air.

In an alternative embodiment, the present systems may be designed to include and support different HTEs. For example, where the HTE used may be subject to physical degradation over time or where the HTE is not foam or rigid refrigerant, such as an ice filled plastic bag, alternative HTE collar supports may be used to maintain the HTE suspended above the payload. When assembled, the payload container may be suspended from and spaced from the sidewalls of the base container creating an air filled space around the payload. Additionally, the HTE may be suspended above the payload, with substantially all of the HTE's surface area on at least one side exposed to the air filled space so as to maximize heat transfer.

As described above, throughout this specification, the term "adjacent to" and other positional language is intended to mean that the components are near one another, but not necessarily touching, and that they may or may not have one or more components therebetween. Therefore, in the present embodiments, in which at least one HTE is configured to be positioned "adjacent" to a first face of the payload container, this language is intended to include the possibility of e.g., a spacing element, such as the first horizontal spacing element, being positioned between the payload container and the HTE. By way of non-limiting example, as depicted in FIG. 1, payload container 120 has two HTEs 110 located above the payload container. These HTEs are considered to be "adjacent to" the payload container, even though there is a spacing element 115 therebetween.

As used herein, the term "shipping container" includes for example SCs, such as foam coolers, inflatable bladders and other hollow structures, composite structures that use materials resistant to heat transfer and the like. SCs may include pre-formed, commercially available SCs that are known to those skilled in the art, or they may include customized SCs in accordance with the present description. The containers may include for example containers having five sides in one contiguous container (i.e., four sides and a bottom side), plus a lid; but they are not limited to such configurations. In the figures, a lid (130, 235, or 335) is shown. The lid component caps the insulated container system. The closure method of the container system ensures that other components of the container system do not become open during shipping. The container system closure method may be for example, an RSC corrugate closure carton, which is taped closed. Any closure method known to those skilled in the art may be used. SCs may be closed and/or further secured by any method known to those skilled in the art. The closing method may include for example, taping, strapping, shrink wrapping or other closure methods known to those of skill in the art.

According to further embodiments, non-limiting examples of which are described further below, the SC may be a multipart SC, such as a multipart modular SC that may be assembled for example, either before, during or after other components of the present systems are incorporated therein, and before shipping.

As used herein, the terms "spacers" or "spacing elements" or "supports" refer to any part of the present systems, kits, products, or methods, that space a payload container, HTE and/or other components of the present systems, kits, products, and methods from the sidewalls of a SC and/or spaces the payload container, HTE and/or inside wall of the SC from one another.

According to example embodiments, a spacer configured to space the payload container from inside walls of the SC, may include spacers that are part of or attached to either the payload container and/or the SC. Alternatively, such spacers may be independent of the payload container and SC and may simply be positioned within the SC in a position and manner so as to achieve the desired spacing, such that substantially all of the surface area of the payload or HTE(s) (e.g. refrigerant) is exposed to an internal air filled space of the SC.

According to example embodiments, the spacers, supports or spacing elements may be designed to minimize the amount of contact the inside walls of the SC have with a payload container, or to minimize blocking of air therebetween. Spacers, supports and/or spacing elements may also be designed to minimize contact and/or maximize airflow between HTEs and the payload container, between HTEs and other HTEs (in embodiments having spacing elements between such HTEs), and/or between HTEs and a side, top or bottom of the SC (in embodiments having spacers between the HTE and the SC).

System performance of the present systems may improve when at least a portion of all surfaces of all HTEs are exposed to air. According to non-limiting example embodiments significantly all surface area of at least one HTE may be exposed to air.

By way of example, embodiments the present inventors named the "Vented Heat Transfer Element" embodiments (See FIG. 3) may include HTEs 110 arranged and configured with spacers therebetween 115 such that significantly all surfaces of all HTEs may be in fluid communication with air within the SC. In an example embodiment, at least one HTE may be layered horizontally with the horizontal spacers between them. In another example embodiment, at least one HTE may be layered vertically with the spacers layered vertically between them. In another example embodiment, at least one HTE may be arranged in an array of horizontally and vertically oriented cuboids with spacers layered horizontally and vertically between them.

In another example embodiment, at least one HTE may be loaded into a rack wherein the rack traps, spaces, suspends and supports the HTEs horizontally or vertically or in arrays of horizontal and vertical orientations. In another example embodiment at least one HTE itself is a sealed and hollow structure with openings through its body to allow air to flow through it wherein the hollow structure is filled with heat absorbing material. In another example embodiment at least one HTE itself is a sealed and substantially hollow structure with hollow fins extending from its body to allow air to flow over its surface wherein a substantially hollow structure is filled with a heat absorbing material. In another example embodiment the spacers may be fixed and integral to at least one HTE. In another example embodiment the spacers are integral to at least one HTE and are transient, for example when at least one HTE is frozen in a mold including ridges or fins or convolutions or grooves or other vertical or horizontal spacers but which might disappear as the HTE phases from a solid to a gel or liquid.

According to non-limiting example embodiments, substantially all of the surface area of the payload container (120 in FIGS. 1-5, and 230 in FIG. 6, and 330 in FIG. 7) may be exposed to the air within the SC, while the SC or other components therein still provides stability and physical support to the payload container. In non-limiting example embodiments, all sides of the payload container may be directly exposed to air within the SC. In other embodiments only the sides, e.g., four walls—depending on the shape of the payload container, or the four sides and one other surface of the payload container may be directly exposed to free flowing air within the SC, while the other surface(s) of the payload container may be in direct contact with e.g., one or more HTEs.

As used herein, for example with respect to modular systems (described further below) in which a spacer and/or support form part of or are attached to a portion of multipart modular SC, a spacer and/or support may be an "L" shaped structure or made of another design so long as the spacer performs the function of supporting and/or holding a payload or HTE or containment sleeve a predetermined space apart from another component of the container system, e.g. the base container, collar, or sidewalls. The spacer is designed such that substantially all of the surface area of the payload or HTE or containment sleeve is exposed to an internal air filled space of the SC.

The present inventors have discovered that a support structure independent of an SC and/or a payload container used to define a horizontal air space may advantageously reduce manufacturing costs and result in improved design flexibility and design stability and facilitate the loading of a lower HTE from the top of a two-part SC without encountering possible interference from vertical spacers arranged and configured to the interior sidewalls of an SC.

Thus, the present application also includes such independent horizontal spacing elements, which may also be referred to as "shuttles" herein. Various non-limiting example embodiments of example horizontal spacing elements have been contemplated, but other spacing elements may be used that space the desired components from one another while not significantly interfering with airflow between such components. Various shapes, sizes and configurations are contemplated. By way of non-limiting example, independent horizontal spacing elements may include for example any of the spacing elements depicted at FIGS. 8-10 or other configurations.

Although spacing elements may be referred to as "horizontal" spacing elements, such a reference to configuration is not intended to be limiting. In the embodiments depicted in the present FIGS. 1-7, the spacing elements, 115, 220 and 325 are referred to as horizontal to describe that essentially, the spacers are essentially parallel to the first and second faces of the payload containers depicted therein. Thus, it can easily been seen that these particular spacers may be used to space the payload container 120 from HTEs 110 (see e.g., FIG. 1), HTEs from the SC (see e.g., FIG. 2), or HTEs from one another (see e.g FIG. 3).

It is contemplated that when the SC is e.g., loaded from the side or turned on its side, the spacers may not literally be horizontal any longer, but such embodiments are nevertheless intended to be included herein.

Figure 7:
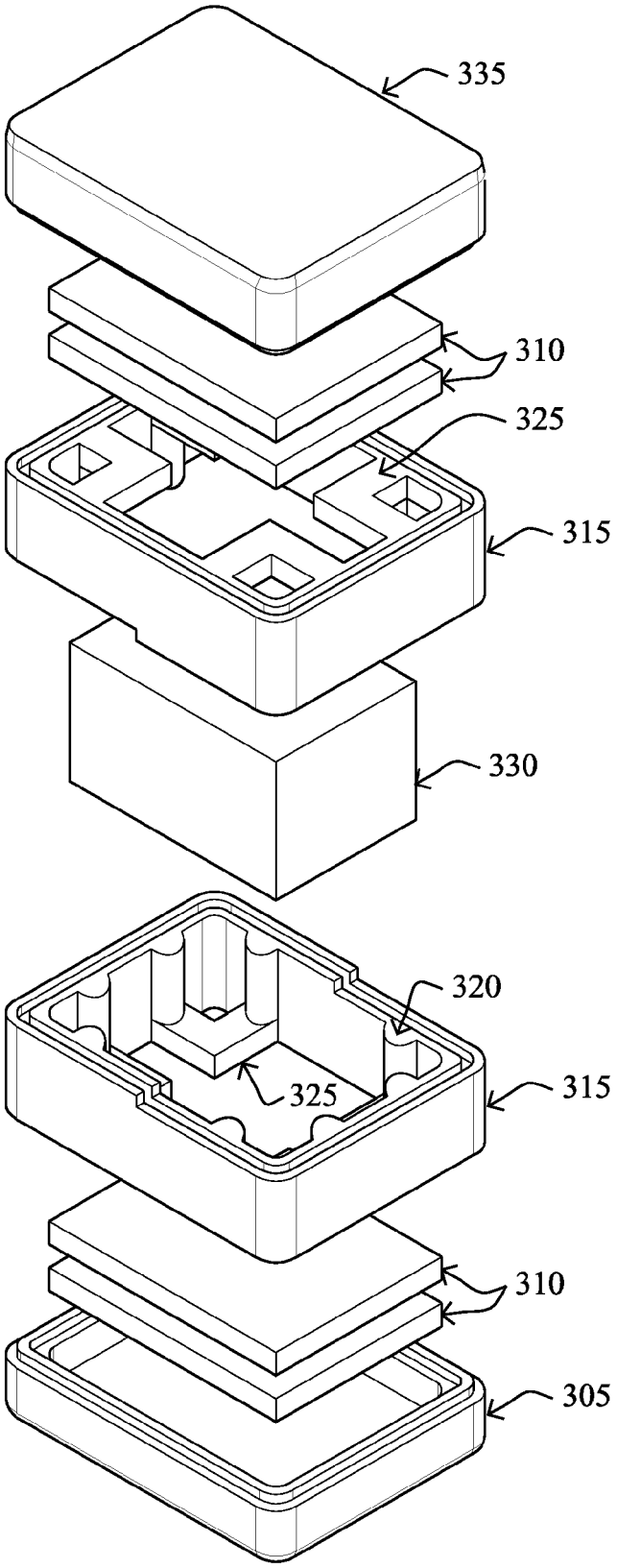
FIG. 7 depicts an exploded perspective view of a system according to example embodiments of the present invention in which the SC is a multipart modular container having vertical supports, or bumpers, for spacing the payload container from the SC, and horizontal spacers, attached to or part of a portion of the SC itself.

As indicated herein, the horizontal spacing elements may according to example embodiments be independent of other components of the present systems, or alternatively, they may comprise a part of e.g., a modular SC as depicted for example in FIG. 7, element 325.

Referring to the Figures, FIG. 1 depicts a non-limiting example embodiment of a system in accordance with the present invention. In particular, according to FIG. 1, a payload container 120 is provided, having at least a first face (the top face of the payload container in FIG. 1), and a second face on an opposite side of the payload container from said first face (i.e., the bottom face of the payload container in FIG. 1). The payload container 120 in FIG. 1 is configured to be positioned within and spaced from inside sidewalls of a SC (in FIG. 1 the SC comprises two parts, a base container 105 and a lid 130). The payload container 120 is spaced from inside walls of the SC by bumpers 125 that are in FIG. 1, attached to sides of the payload container. At least one HTE 110 is configured to be positioned adjacent to the first face of the payload container 120 when the payload container and the HTE are positioned within the SC. In FIG. 1, the HTEs adjacent to the first face of the payload container are elements 110 above the payload container 120. In the depicted embodiments, a first horizontal spacing element 115 (above the payload container) is configured to space the first face of the payload container from the at least one HTE, while allowing air to flow between the payload container and the HTE configured to be positioned adjacent thereto; and a second horizontal spacing element (115 below the payload container) is configured to be positioned adjacent to the second face of the payload container (i.e., on the opposite side of the payload container from the first spacing element).

Figure 4:
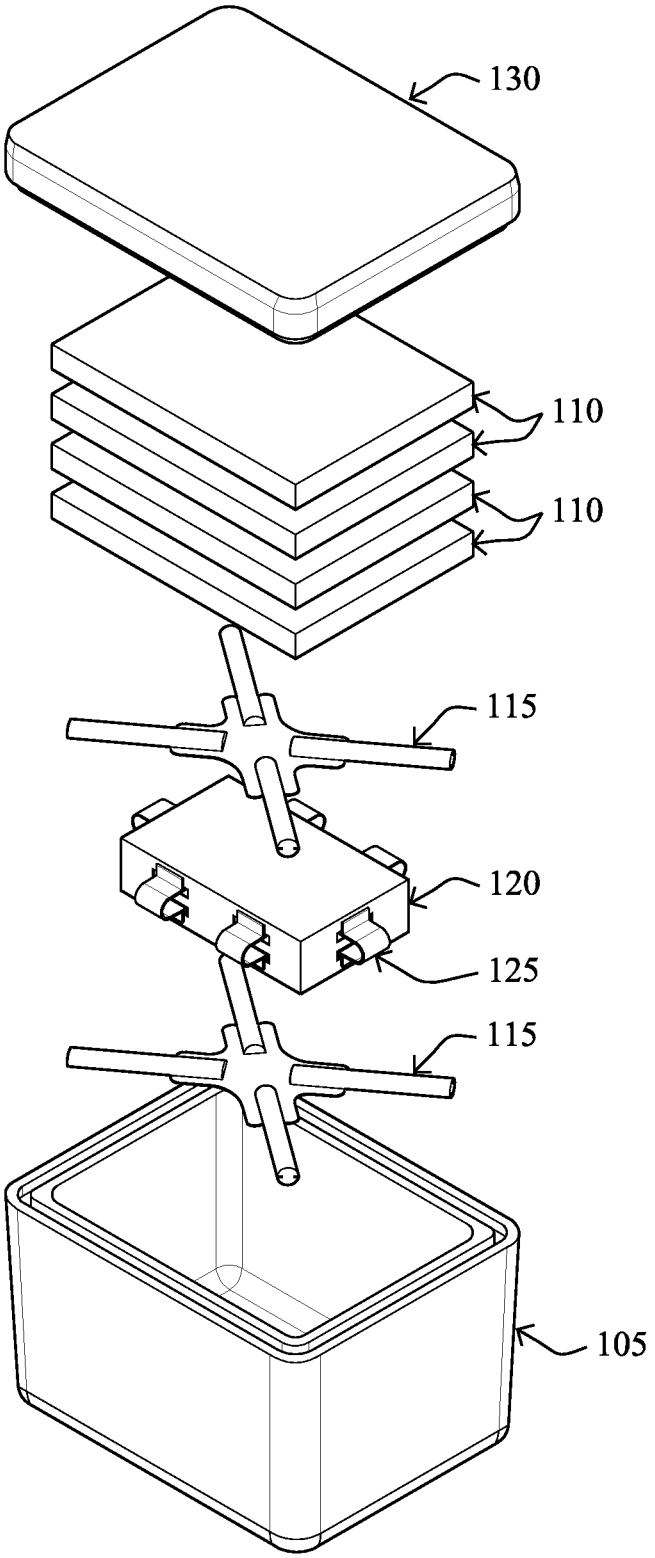
FIG. 4 depicts an exploded perspective view depicting non-limiting embodiments of a system according to example embodiments of the present invention, which include spacers in direct contact with first and second faces of the payload container. Four HTEs are in the depicted embodiment.

FIG. 4 depicts similar embodiments, but FIG. 4 shows embodiments including more HTEs 110 above the payload container. The embodiments depicted in FIG. 4 do not include HTEs below the payload container, but it is contemplated that such embodiments are encompassed by the present invention.

It is also contemplated that two or more HTEs may be placed side by side in the present system. In such embodiments, it is possible that the side by side HTEs may each be separated from the payload container (or other HTEs or the SC walls) by one or more horizontal spacers (e.g., shuttles).

The present inventors have found that placing HTE mass both above and below a payload container (as depicted in FIG. 1, but not required in all embodiments) may improve the performance of the present systems, for example when the SC may be oriented on its side and/or upside down, for example during the shipping process.

It is further contemplated that a second or more HTE may be adjacent to any side of the payload container in addition to being adjacent to a first face. Therefore, in example embodiments one or more HTEs may be indirectly or directly positioned above, below and/or aside payload containers within the scope of the present invention.

Contemplating the buoyancy effect of warm air rising in a closed free-convection system, the present inventors made the following discoveries: when a free-convection system is oriented upright, a HTE above a payload container phases faster than a HTE below a payload container; and when a free-convection system is oriented on its side, a HTE on either side of a payload container phases at approximately the same rate.

According to non-limiting example embodiments, the present systems may further include at least one HTE configured to be positioned adjacent to the second face (opposite) of the payload container. Again, by use of the term adjacent to, the inventors are intending to include embodiments that may have other elements between the payload container and the one or more HTEs located on this side of the payload container, such as a spacing element. By way of example in referring to FIG. 1, payload container 120 has two HTEs 110 located under the payload container as well as the two HTEs above the payload container. These lower HTEs are considered to be "adjacent to" the payload container, even though there is a spacing element 115 therebetween.

According to non-limiting example embodiments, in the present systems, the payload container may be configured to be spaced from inside sidewalls of the SC using supports selected from the group consisting of: supports are part of, attached to or are connected to the payload container (see e.g., 125 of FIG. 1); supports that are part of, attached to or are connected to the SC (see e.g., 225 in FIG. 6, and 320 in FIG. 7); supports that are part of, attached to or or connected to the HTE and supports independent of the payload container, the SC and or the HTE.

Contemplating the concurrent and independent discovery that regulating air space dimension affects system performance, and contemplating the complexities of manufacturing shuttles of various depths and various dimensions to suit different cooler systems and payload product requirements, the present inventors arrived at several possible shuttle designs, which may be advantageous, particularly when used as part of the present systems.

Horizontal spacers in accordance with the present invention may include various types of spacers or shuttles. By way of non-limiting example embodiment, the present inventors envision an example embodiment they named the "Assembled Non-Vented Universal Shuttle" depicted for example in FIG. 8. The Assembled Non-Vented Universal Shuttle may be constructed with a connector 405 to which at least one shuttle spoke 410 of various lengths, diameters, shapes and materials may be arranged and configured by various methods. An example embodiment shuttle spoke 410 may be cylindrical in shape reducing the contact area along the apex of the radius of the cylinder between each shuttle spoke and at least one HTE, and at least one other HTE, at least one payload container, or at least one inside surface of a SC. Another example embodiment shuttle spoke 410 may be faceted or squared in shape increasing the contact area between each shuttle spoke and at least one HTE and at least one payload container, at least one other HTE, or at least one inside surface of a SC; where the mass of the payload and/or the HTE require additional support.

Figure 8:
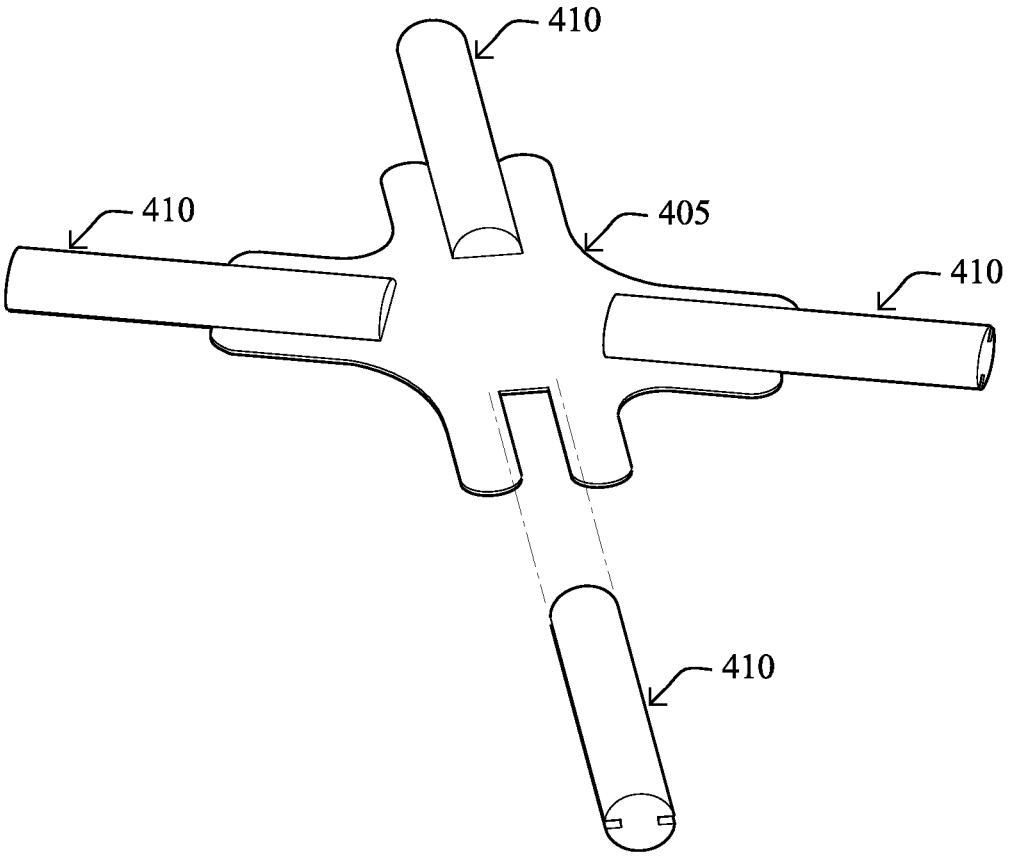
FIG. 8 depicts non-limiting example embodiments of an example an independent horizontal spacer, or shuttle, that may be used in the present systems, kits and methods where a horizontal spacer is not attached to the payload container, HTE or SC.

Thus, non-limiting embodiments of the present shuttles may include a connector to which three or more (for stability) shuttle spokes are attached, in which the shuttle spokes are configured by material and/or shape such that air may flow through the spokes. The connector may have a depth that is smaller than the depth of the shuttle spokes as depicted in FIG. 8, which allows for air flow under and over the connector.

Other envisioned, non-limiting example embodiments of a shuttle spoke may have profiles that are squared, faceted, scalloped or dentiled rather than radiused as in various cubeoidal, pyramidal or polygonal shapes.

The connector 405 may have an arrangement of connection angles such that the connector could be arranged and configured with at least one shuttle spoke to fit with and function within coolers of various dimensions with similar width to length ratios.

Example shuttles may exhibit improved performance over other forms of spacers. According to example embodiments, the spokes are radiused, and the butt end of the spokes are separated by an unsupported gap in between. This gap allows air to circulate through the part (if it were an "X", air would dam at the intersection) and the gap combined with the radiused profile of the spoke decreases the surface area of the spaced apart components (such as the payload container and HTE) that are in continuous communication with air. The converse of radiused spokes would be squared or faceted spokes, which would have more surface area in contact with the payload container and HTEs but would also provide more support to larger or heavier payloads.

The present example shuttles may also provide improved durability. Radiused shuttle spokes that are rigid and are mounted to a connector that is flexible allows the spokes to roll during drops and vibration decelerating the torque force at the flexible connector and relieving the torque force on the brittle spokes reducing the risk that the spokes will break.

The present example shuttles may also provide improved manufacturability. The spoke and groove configuration of example shuttles allows the inventors to use one connector to produce shuttles for various possible "off-the-shelf" SC sizes already on the market. Connectors may be made with steel-rule dies that require little lead-time to build and are relatively inexpensive to build. In practice there may be two shuttle connectors: one that produces shuttles for SCs that are rectangular in shape and one that produces shuttles for SCs that are square in shape. The spokes may be fabricated out of foam for example using a hot wire, so there is no molding tool involved. In the case of fabricated foam spokes, the manufacturer would set the down-cut wires on the foam fabricating equipment to any given length and cut custom-sized spokes. The spokes may then be hand-mounted to a universal shuttle connector and the shuttle is complete.

The present example shuttle is beneficial in three significant ways: first, molding tools for most materials require 6-8 weeks lead-time. By contrast, the present example shuttles takes a few days to develop and manufacture, so production lead-time is greatly reduced. Second, it reduces the capital cost of producing the shuttles, as molding tools for most materials generally cost tens of thousands of dollars per tool, and there could potentially be hundreds of different SC system designs each requiring its own shuttle tool. Related to this, adjustable spokes allows one to use any two-part cooler system on the market, thereby avoiding the cost of building SC molding tools as well. And finally, prototypes can be prepared within minutes that will be exactly the same as finished commercialized product. This shortens the testing cycle and improves customer service.

Figure 9:
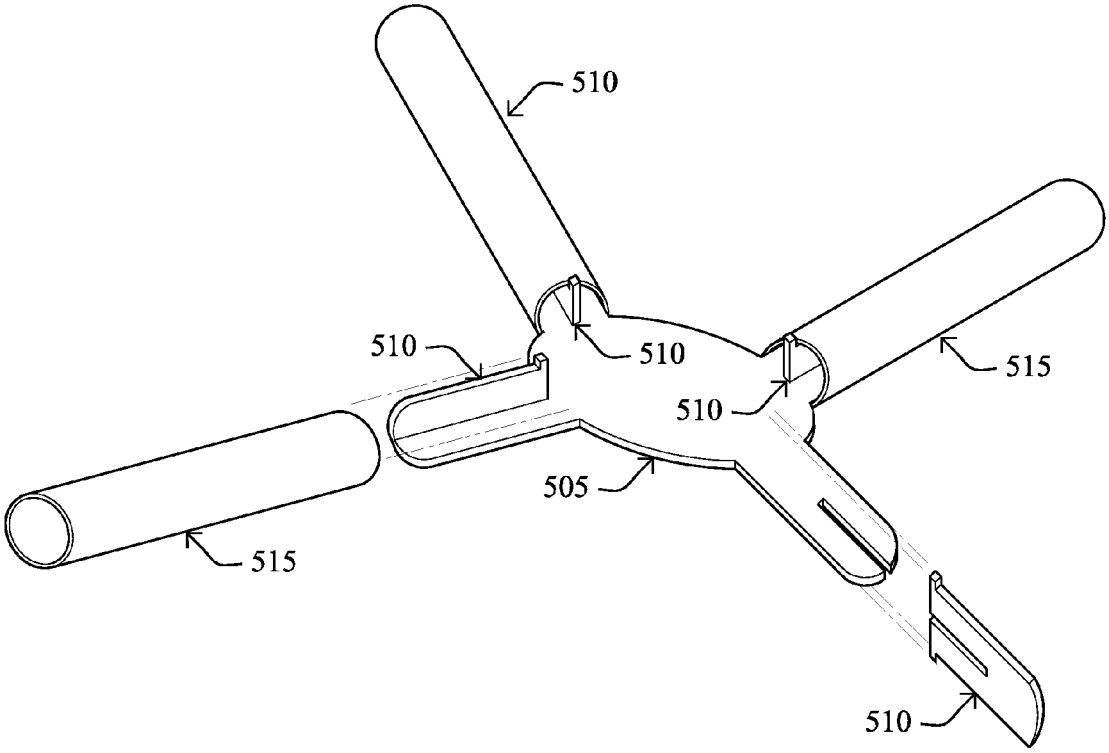
FIG. 9 depicts non-limiting example embodiments of an example shuttle that may be used in the present systems, kits and methods.

The present inventors envision other example embodiments of a shuttle they named the "Assembled Vented Universal Shuttle", which is depicted for example in FIG. 9. The Assembled Vented Universal shuttle may be assembled with a connector 505 and at least one substantially hollow shuttle spoke 515 of various lengths, diameters and attachment methods and materials arranged and configured thereto such that ventilation through the at least one shuttle spoke occurs. This example embodiment may also include a vertical support 510 integrated into the connector. The vertical support may support the internal dimension of at least one shuttle spoke 515 and provide sufficient contact surface area between the connector 505 and the inside surface of at least one shuttle spoke such that a friction fit between the connector and at least one shuttle spoke could be realized.

Figure 10:
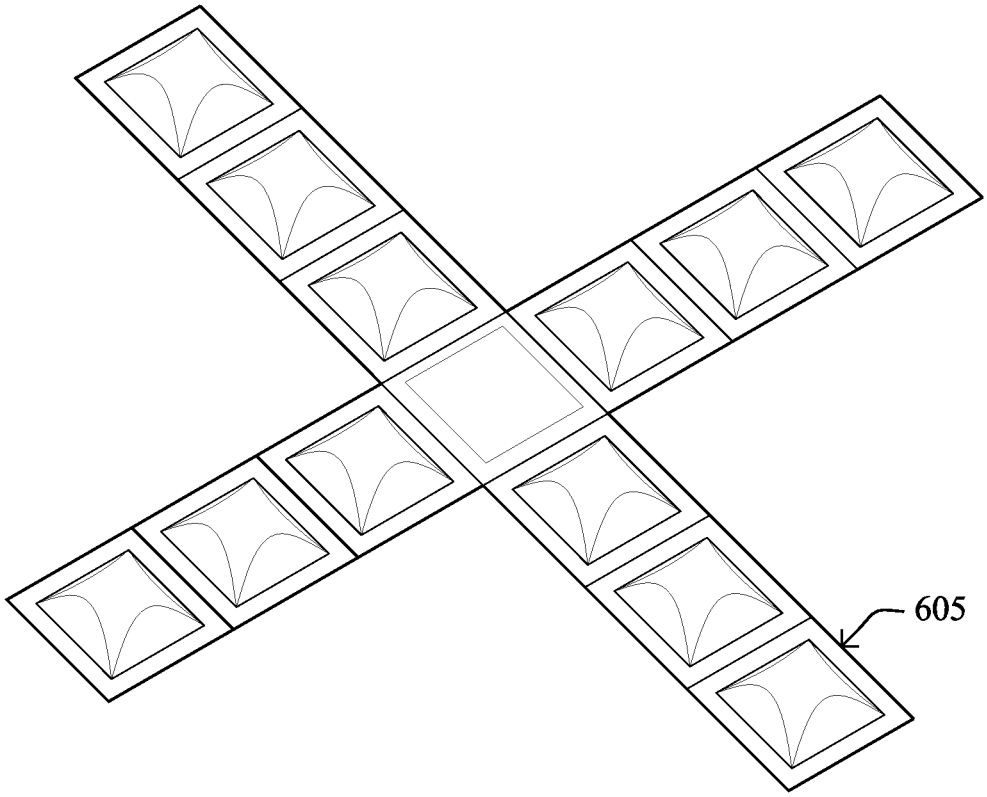
FIG. 10 depicts non-limiting example embodiments of an example shuttle that may be used in the present systems, kits and methods.

The present inventors also envision other example embodiments of a shuttle they named the "Bubble Shuttle", depicted for example in FIG. 10. The Bubble Shuttle is substantially hollow but not ventilating and may be for example, a fluid filled bladder 605 the depth dimension of which may be regulated by the degree of pressure introduced therein.

Another envisioned example embodiment of a Bubble Shuttle may be a tube with closed ends or a vacuum-formed clamshell.

The present inventors envision another example embodiment of a Shuttle they named a "Contiguous Shuttle." A contiguous shuttle requires no assembly. An example embodiment of the contiguous shuttle may be a molded, extruded, wire-cut, fabricated or a die-cut piece of rigid or semi-rigid material with at least three supports radiating from a center. Another example embodiment of the contiguous shuttle may be a section of a large diameter tube sized such that substantially all of the edge of the tube is in direct contact with at least one Payload container and at least one HTE and wherein some portion of the tube sidewall is in direct contact with an SC.

The present inventors envision another example embodiment of a Shuttle they named the "Adjustable Depth" shuttle. The adjustable depth shuttle is an assembly of thinner shuttles layered one upon the other, attached to or detached from one another, making the depth dimension of a shuttle adjustable.

The present inventors envision another example embodiment of a Shuttle they named the "Waffle Disk Shuttle". The waffle disk shuttle is a sheet or disk whereon a three-dimensional waffle, convoluted or corrugated dimension is arranged and configured such that air may move freely through the architecture of the peaks and valleys on its surface and such that the peaks have minimal surface contact with at least one HTE and at least one payload container. The waffle disk shuttle may have holes or fenestrations through the face of the disk to facilitate air flow, and the edges of the waffle disk shuttle may include radiused, scalloped, faceted or dentiled edges to facilitate airflow around the disk while bracing the disk against the inside surface of an SC to prevent the disk from rotating out of position. Another example embodiment of the waffle disk shuttle includes a waffle disk shuttle fastened or glued to the top, bottom or sides of at least one payload container. Another example embodiment of the waffle disk shuttle includes a flat sheet with spacers fastened or glued thereon to the top and/or bottom of its facing surfaces.

Although the figures depict a single shuttle spacing sets of elements apart, it is contemplated that multiple shuttles may be used to space elements from one another.

The present inventors envision another example embodiment of a shuttle they named the "Heat Transfer Element Shuttle". A Heat Transfer Element Shuttle includes at least one HTE wherein vertical structures for establishing a vertical air space are arranged and configured thereon. In an example embodiment of a Heat Transfer Element Shuttle a material may be applied to at least one surface of at least one HTE. In another example embodiment the vertical structures are incorporated into the interior structure of at least one HTE. In another example embodiment at least one HTE is a sealed and hollow structure with vertical structures for establishing a vertical air space that are integral thereto wherein the hollow structure is filled with a heat-absorbing material. In another example embodiment the spacers are integral to at least one HTE and are transient, for example when at least one HTE is solid in a mold including vertical structures that might act as a spacer but which might disappear as the solid HTE phases from a solid to a gel or liquid.

All of the systems described and included herein may further include the SC or portions thereof.

In an example embodiment of the present systems, independent bumpers may be detached and independent of any other element of the present systems. Thus, in these embodiments, bumpers (horizontal and/or vertical) are independent of a SC, a payload container, a HTE and (if present) a Payload container Bumper collar (as described further below). Another example embodiment of the independent bumper pack may include vertically placed shuttles between the payload container and the SC.

An independent bumper pack embodiment may be constructed having at least one HTE on one side of the payload container (e.g., below the container) and at least one HTE on the other side (e.g., above) the payload container. A system may be provided which includes a lower HTE, which is configured such that it may be positioned or placed in a SC. At least one lower shuttle may be placed on top of at least one HTE at the bottom of the Base. In one embodiment of the Independent Bumper Pack at least one lower Independent Bumper may be placed on top of at least one lower shuttle and is positioned to receive the bottom of at least one payload box. At least one payload box may be placed into, onto or next to a lower independent bumper. At least one upper independent bumper may be inserted into the horizontal cavity around the perimeter of at least one payload box. In another example embodiment of the independent bumper pack the lower independent bumper is omitted. At least one upper shuttle may be placed on top of at least one payload box, an upper HTE is loaded into the system on top of at least one shuttle and the system is closed with an SC Lid.

The present inventors envision another example embodiment of an Active Bumper Pack they named the "Bumper Shuttle Pack". The bumper shuttle pack includes at least one shuttle to which at least one bumper is arranged and configured thereon. The bumper shuttle traps, spaces, suspends and supports at least one payload box within an SC. An SC lid may have at least one recess on an inside surface such that at least one bumper on the bumper shuttle can nest inside at least one relief.

The Bumper Shuttle Pack may be constructed using an SC Base into which a lower HTE may be optionally placed. At least one lower bumper shuttle is placed on top of a lower HTE (or on the base of the SC, such that the bumpers on at least one lower bumper shuttle face upwards. A payload box is placed on top of at least one lower shuttle and next to the bumpers on the shuttle. At least one upper shuttle is placed on top of at least one payload box such that the bumpers on the bumper shuttle are next to at least one payload box. An upper HTE is loaded into the system on top of at least one bumper shuttle such that at least one payload box and at least one HTE are in fluid communication with air. The system may be closed with an SC lid.

In another example embodiment of an Active Bumper Pack, the bumpers are arranged and configured to at least one HTE. A HTE Bumper Pack may include for example, at least one shuttle and/or at least one bumper that are arranged and configured thereto with at least one HTE. At least one shuttle and at least one bumper trap, space, suspend and support at least one payload box away from at least one HTE such that at least one payload container and at least one HTE are in fluid communication with air.

By way of non-limiting example, HTE Bumper Packs may be constructed for example, using an SC Base into which a lower HTE with Bumpers integrated into its dimensions is placed such that the Bumpers are facing upwards. A payload container is inserted into the SC over at least one lower shuttle and next to the bumpers integrated into a lower HTE. An upper HTE is placed on top of at least one payload container such that the bumpers integrated into at least one HTE are facing downwards. The bumpers integrated into at least one HTE are inserted into the horizontal air space at the perimeter of at least one payload container such that at least one payload container and one HTE are in fluid communication with air. The system is closed with an SC Lid.

In another example embodiment of an Active Bumper Pack, the bumpers may be eliminated from the system all together. In such embodiments, the Independent Payload container Pack may include for example, at least one payload container that is significantly smaller dimensionally than the inside dimensions of an SC Base walls such that at least one payload container may be capable of moving freely within a cavity created by SC walls, and such that at least one sidewall face of at least one payload container is in direct contact with the inside surface of an SC.

According to example embodiments, the Independent Payload container Pack system may be assembled/packed into e.g., an SC Base into which a lower HTE may optionally be placed. At least one lower shuttle may be placed on top of at least one HTE or directly into the SC if no lower HTE is present. A payload container is placed on top of at least one lower shuttle such that an irregular and dynamic air space is arranged and configured. At least one upper shuttle is placed on top of at least one payload container. A HTE is placed on top of at least one upper shuttle and the container may be closed with an SC Lid.

It should be considered, that the inventors contemplate that this method, as well as all of the methods provided herein, may be performed sequentially or randomly, so long as the components end up being arranged as contemplated and set forth herein. For example, components may be pre-packed together prior to being placed within a SC.

Bumpers provided herein may be of various shapes, sizes and configurations. For example, a solid bumper may be provided, which may include e.g., die-cut, molded or fabricated plastic, metal or foam and may be mechanically arranged and configured or glued to the sidewall of at least one Payload container, Payload container Cage or Payload container Bumper collar. The Bumper in this embodiment may be substantially solid.

Also provided herein are "Vented Bumpers", which may include for example stamped, molded or extruded plastic or metal and may clip to the surfaces of at least one Payload container, Payload container Cage or Payload container Bumper collar as described herein, through a die-cut opening in the sidewall of at least one Payload container Payload container Cage or Payload container Bumper collar. The bumper in this example embodiment may be for example, substantially hollow thereby allowing air to flow through it.

Also provided is a "Bubble Bumper", which may include an air, gas or fluid-filled bladder the depth dimension of which may be regulated by the degree of pressure introduced therein, a tube with closed ends or a vacuum-formed clamshell fastened or welded together. Formed in this manner, the bumpers described herein may be mechanically arranged and configured or glued to the exterior sidewall of at least one Payload container, Payload container Cage or Payload container Bumper collar.

Further provided is a "Payload container Bumper", which may have bumpers that are integral to the material used to make at least one payload container or at least one Payload container Bumper collar.

Also provided herein are "Adjustable Bumpers", which may be assembled in layers of thinner spacers thereby making adjustable the depth of the bumpers.

Non-limiting examples also include "Closing Bumpers", which may include stamped metal or formed wire clips that clip over the sidewalls and top and bottom of at least one Payload container or are hinged to and clip over the sidewalls and top of at least one Payload container to both form the bumper structure and to close at least one Payload container without tape.

According to non-limiting example embodiments, shuttles and bumpers may be incorporated into bands or straps arranged and configured to wrap around or fit over at least one payload container such that the band traps, spaces, suspends and supports at least one payload container and at least one HTE such that at least one payload container and at least one HTE are in fluid contact with air. In an example embodiment, the bellybands may include die-cut foam. In another example embodiment the bellybands may be Fluid Filled-Bladder the depth dimension of which may be regulated by the degree of pressure introduced therein.

According to non-limiting example embodiments, a Payload container Belly-Band pack may be constructed for example using an SC Base into which a lower HTE is placed. At least one Payload container with at least one Bellyband arranged and configured thereon may then be optionally placed on top of at least one lower HTE. An upper HTE is placed on top of at least one Payload container with at least one Bellyband arranged and configured thereon. The system is then closed with an SC Lid.

Accordingly to non-limiting example embodiments, it may be advantageous to add a payload container bumper collar for additional airflow and heat transfer through the system. According to non-limiting example embodiment bumpers may be arranged and configured on at least one Payload container Bumper collar into which at least one payload container may be placed.

According to example embodiments, at least one lower shuttle or horizontal spacer may optionally be placed on top of at least one HTE at the bottom of an SC Base (or placed directly on the base if no bottom HTE is present). At least one Payload container Bumper collar is inserted into the SC Base on top of at least one lower Shuttle and at least one Payload container is inserted into at least one Payload container Bumper collar. At least one upper shuttle (above the payload container) is placed over at least one payload container. At least one HTE may then be loaded into the system on top of at least one Shuttle and the system is closed with an SC Lid Bumpers may be arranged and configured on or attached to or abutting at least one Payload container Bumper collar such that significantly all the interior and/or exterior surface area of at least one Payload container Bumper collar and the surface area of at least one HTE are in fluid communication with air.

A non-limiting example embodiment of a Payload container Bumper collar may include for example, at least one band of rigid, semi-rigid or flexible material configured and arranged to wrap around at least one payload container.

A non-limiting example embodiment of at least one Payload container Bumper collar may include at least one die-cut corrugated band that has been scored, folded and glued or mechanically fastened such that bumpers are integral to the band. In another example embodiment, a Payload container Bumper collar may include at least one band whereon a three-dimensional waffled, ridged, corrugated, finned or convoluted pattern is arranged and configured such that air may move freely through the architecture of the peaks and valleys in the dimensioned pattern.

In another example embodiment, a Payload container Bumper collar may be arranged and configured with at least one Fluid-Filled Bladder the depth dimension of which may be regulated by the degree of pressure introduced therein.

In another example embodiment, a Payload container Bumper collar may include at least one band of rigid, semi-rigid or flexible such that Bumpers are integral to the band and the band may be configured and arranged to cooperatively fit with at least one joint in an SC.

In another example embodiment of an Active Bumper Pack, the bumpers may be independent structures that are inserted into a track that is molded into the sidewalls of a SC, such as an SC. This "Keyed Bumper Track Pack" may include bumpers that are keyed and cooperatively fit into a keyed vertical groove in the wall of an SC Base thereby allowing the bumpers to move freely within the groove. Arranged and configured in this manner, at least one HTE may be introduced into an SC Base without interference from at least one Bumper. At least one bumper is inserted into the keyed grooves where at least one HTE traps is inserted on top of at least one bumper thereby trapping it and such that at least one Payload container and at least one HTE are in fluid communication with air. Bumper dimensions are adjusted by introducing bumpers of various dimensions into the keyed channels.

The Keyed Bumper Track Pack may be constructed for example, using an SC Base with keyed channels molded into its sidewalls into which a lower HTE is placed. At least one lower Shuttle is placed on top of at least one HTE. Keyed bumpers are inserted into keyed channels molded into the Cooler Base. A payload container is placed into an SC Base on top of a lower Shuttle and next to at least one keyed bumper. At least one upper Shuttle may be placed on top of at least one payload container. At least one HTE is placed on top of at least one upper shuttle and the container is closed with an SC Lid The HTE supports, spacers, shuttles, bumpers, etc. are designed such that substantially all of the surface area of the HTE may be exposed to the internal air of the SC on at least one side of the HTE. In other non-limiting example embodiments, substantially all of the surface area of the HTE may be exposed to internal air on two or more sides.

In example embodiments, even though it may appear that one or more sides of one or more HTEs may be contacting internal walls or surfaces of the SC, it is contemplated that such surfaces of the HTE(s), may in fact also be substantially exposed to internal air. In particular, it is noted that the HTE sides and or the SC sides may be imperfect and or may not fit perfectly together such that a seal is formed. In fact, such a seal would be undesirable for example with respect to packing and unpacking the SC, and with respect to heat transfer. Further it contemplated that the HTE may have air contacting its sides due to the buoyant pressure of warm air rising during convection.

Where it is desired to cool a payload using the heat transfer principle of free convection, the container system must be orientated such that at least some portion of at least one HTE is situated above the payload container. In this scenario, heat entering the walls of the SC warms the air in the heat transfer system, which convects upward and displaces the cooler air that is in contact with the surfaces of the HTE.

In another example embodiment of the present invention, bumpers are incorporated into a ventilating cage that traps, spaces, suspends and supports at least one payload container from the SC walls and at least one HTE such that at least one payload container and at least one HTE are in fluid communication with air. In an example embodiment, at least one horizontal spacer and at least one vertical spacer is arranged and configured on the interior surface, exterior surface or both surfaces of the Payload container Cage. In another example embodiment, at least one horizontal spacer is arranged and configured on the interior surface, exterior surface or both surfaces of the Payload container Cage and at least one vertical spacer is a shuttle. In another example embodiment, at least one vertical spacer is arranged and configured on the interior surface, exterior surface or both surfaces of the Payload container Cage and at least one horizontal spacer is independent of the payload container Cage.

In an embodiment having a Caged Payload, a payload container is inserted into at least one Payload container Cage. In an example embodiment, at least one Payload container Cage is placed on top of at least one lower HTE and at least one upper HTE is placed on top of at least one Payload container Cage. In another example embodiment at least one lower shuttle is placed on top of at least one lower HTE and at least one Payload container Cage is placed on top of at least one lower shuttle and at least one upper shuttle is placed on top of at least one payload container and at least one HTE is placed on top of at least one upper shuttle. In another example embodiment, at least one Payload container Cage is placed on top of at least one lower HTE and at least one Independent Bumper is placed into the airspace at the perimeter of the Payload container Cage and at least one upper HTE is placed on top of at least one Payload container Cage. The container may be closed with an SC Lid.

In another example embodiment bumpers may be incorporated into a ventilating cage that traps, spaces, suspends and supports at least one HTE from at least one Payload container such that at least one HTE and at least one payload container are in fluid communication with air. In an example embodiment, at least one vertical spacer is arranged and configured on the interior surface, exterior surface or both surfaces of the HTE Cage.

The Caged HTE Pack may be constructed using at least one HTE, which is inserted into at least one HTE Cage. At least one lower HTE Cage may be placed into an SC Base Cage such that the vertical spacers are facing upwards. At least one payload container is placed on top of the lower HTE Cage and at least one upper HTE Cage is placed on top of at least one Payload container such that the vertical spacers are facing downwards. The container is closed with an SC Lid. An alternative configuration may include at least one lower HTE Cage flipped over such that the vertical spacers are facing downward and at least one upper HTE Cage flipped over such that the vertical spacers are facing upward.

The present inventors have discovered that removing all HTEs increases resistance. In a closed system wherein a contiguous air space surrounds at least one payload container and there is no HTE present, the contiguous air space augments the insulative effect of the container and modulates the convective current within the container.

An example embodiment of this discovery includes arranging and configuring at least one shuttle and at least one bumper inside a Container such that significantly all of the surface area of at least one payload container is in fluid communication with air.

The present inventors have found that modifying at least one Payload container to allow for ventilation through it improves performance.

An example embodiment includes at least one channel of air moving through e.g., approximately the center of at least one payload container thereby increasing the surface area of at least one payload container such that at least one payload container and at least one HTE are in fluid communication with air. Another example embodiment includes ventilation holes in the top, bottom and/or sidewalls of at least one payload container. In another example embodiment at least two payload containers are arranged and configured into an array with air spaces next to several or all of their surfaces. Any of the shuttles and bumper embodiments disclosed herein may be used to arrange and configure the air spaces described herein.

The present inventors made the following discovery: an airspace arranged and configured around a payload within the interior of at least one payload container improves performance. An example embodiment the present inventors named the Partitioned Minimum Payload, or PMIN, includes payload material arranged and configured such that significantly all of the interior surface area of at least one payload container and the payload therein are in fluid communication with air. An example embodiment includes a partition divided into cells wherein at least some cells form a perimeter of fluid-filled cells surrounding at least one central cell, wherein the cell size, quantity and configuration may be adjustable and wherein pads may be arranged and configured to lift from below and trap from above the payload product within a partitioned payload container. The partitioned cell dimensions may be adjusted by adding slots to the partition members. Another example embodiment includes a Secondary payload container within a payload container in which combinations of bumpers and shuttles are configured such that a contiguous air space is created next to the exterior surface of the interior payload container and the interior surface of the exterior payload container. Any of the shuttle and bumper embodiments disclosed herewith may be used to arrange and configure the air spaces described herein.

In addition to cooling the payload, the present invention can protect payloads from becoming too cold in the case of shipments made during winter or in extremely cold environments. Systems appropriate for winter may try to provide configurations that allow air to be used for insulation.

As in other embodiments herein, although numerous embodiments herein may include shuttles and/or bumpers arranged and configured such that significantly all the surface area of at least one payload container and significantly all the surface area of at least one HTE are in fluid communication with air it is also contemplated that alternative embodiments may include shuttles and bumpers arranged and configured such that at least one surface of at least one payload container and at least one surface of at least one HTE are in constant communication with each other and together may be encapsulated with air. These latter embodiments may be preferable in winter months, for example, because encapsulating at least one payload container and at least one HTE in air limits the heat liberated by the container system.

For another example, although numerous embodiments herein include at least one HTE arranged and configured above and below at least one payload container it is also contemplated that alternative embodiments may include shuttles and bumpers arranged and configured such that at least one HTE is only above or below at least one payload container. The latter embodiments may be preferable in logistical conditions where the orientation of an SC may be controlled, as in a courier-controlled delivery, or in static conditions where an SC may remain fixed, as in a clinic where the SC is used as a back up for mechanical system failure.

Provided herein are systems that include a payload container having at least a first face, and a second face on an opposite side of the payload container from said first face, the payload container being configured to be positioned within and spaced from inside sidewalls of a SC. The at least one HTE is configured to be positioned directly adjacent to the first face of the payload container when positioned in the SC. Also included is a first horizontal spacing element configured to directly contact and space at least one HTE from either an inside top surface of the SC, or from a second HTE, wherein the first horizontal spacing element is configured to allow air to contact and flow across the at least one HTE. Lastly included is a second horizontal spacing element configured to be positioned adjacent to the second face of the payload container.

Figure 2:
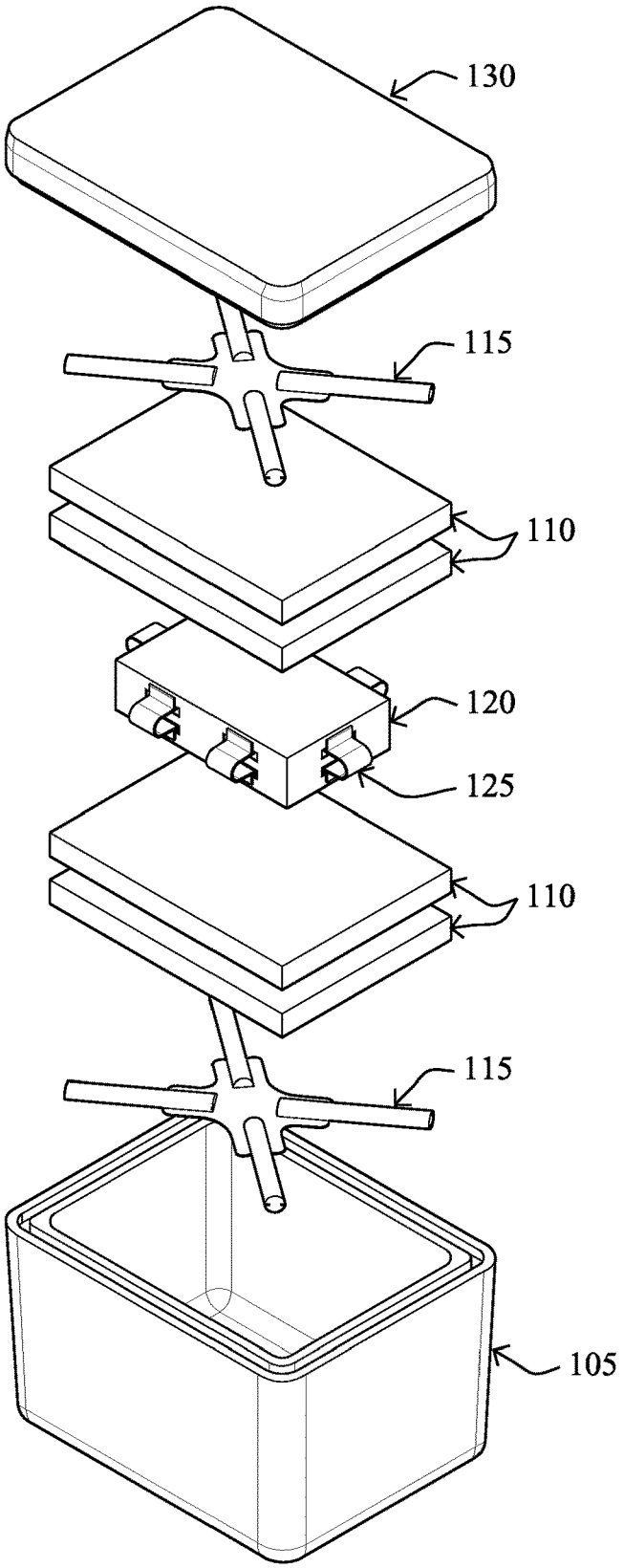
FIG. 2 depicts an exploded perspective view of an alternative configuration of non-limiting embodiments of a system of the present invention, in which spacers and HTEs are in a switched position with respect to the embodiments depicted in FIG. 1.

FIG. 2 depicts non-limiting example embodiments of a system in accordance with the present invention. In particular, according to FIG. 2, a payload container 120 is provided, having at least a first face (the top face of the payload container in FIG. 2), and a second face on an opposite side of the payload container from said first face (i.e., the bottom face of the payload container in FIG. 2). The payload container 120 in FIG. 2 is configured to be positioned within and spaced from inside sidewalls of a SC (in FIG. 2 the SC comprises two parts, a base container 105 and a lid 130). The payload container 120 is spaced from inside walls of the SC by bumpers 125 that are in FIG. 2, which as depicted are attached to sides of the payload container. At least one HTE 110 is configured to be positioned adjacent to the first face of the payload container 120 when the payload container and the HTE are positioned within the SC. In FIG. 2, the HTEs adjacent to the first face of the payload container are elements 110 above the payload container 120. In the depicted embodiments, a first horizontal spacing element 115 (above the payload container) is configured to space the at least one HTE from an inside wall of a SC, while allowing air to contact and flow across the HTE and the SC; and a second horizontal spacing element (115 below the payload container) is configured to be positioned adjacent to the second face of the payload container (i.e., on the opposite side of the payload container from the first spacing element).

Figure 3:
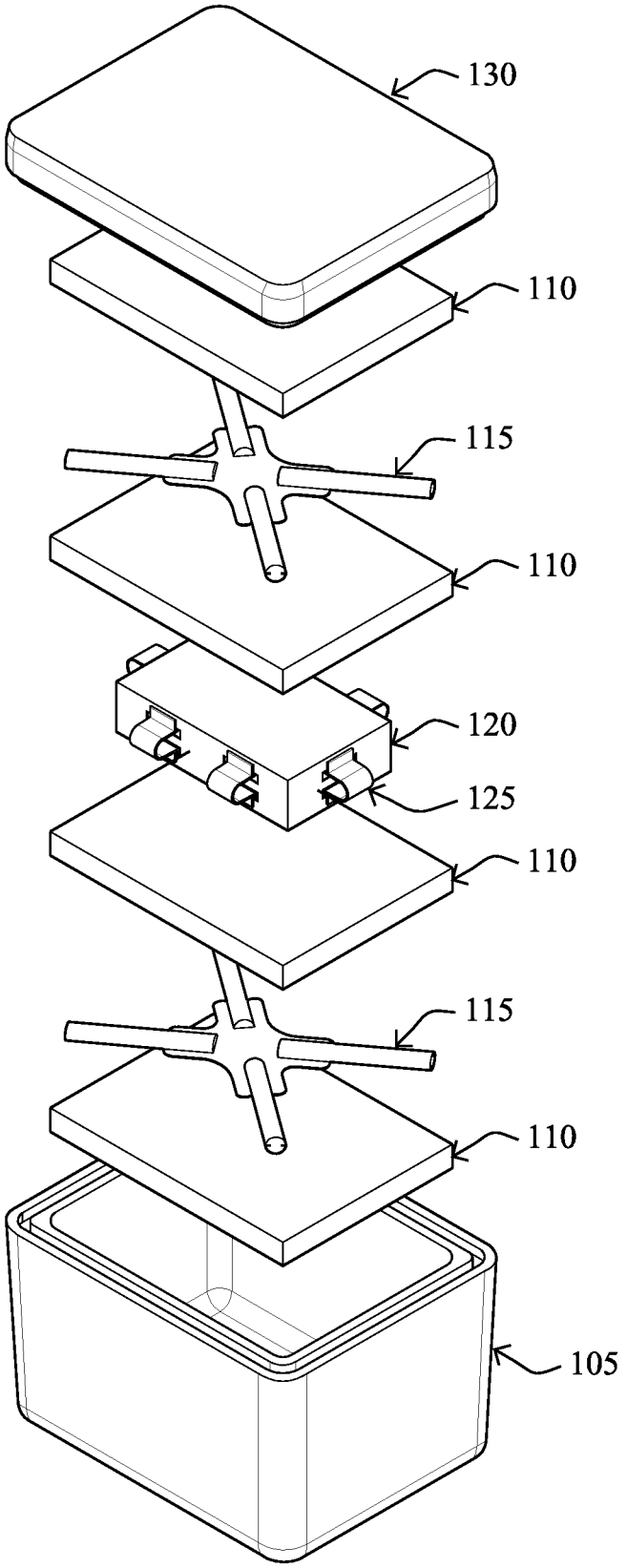
FIG. 3 depicts an exploded perspective view of non-limiting embodiments of a system of the present invention, having vented HTEs, and in particular having multiple HTEs above and below a payload container, with spacers between the HTEs.

FIG. 3 depicts non-limiting example embodiments of another system in accordance with the present invention. In particular, according to FIG. 3, a payload container 120 is provided, having at least a first face (the top face of the payload container in FIG. 3), and a second face on an opposite side of the payload container from said first face (i.e., the bottom face of the payload container in FIG. 3). The payload container 120 in FIG. 3 is configured to be positioned within and spaced from inside sidewalls of a SC (in FIG. 3 the SC comprises two parts, a base container 105 and a lid 130). The payload container 120 is spaced from inside walls of the SC by bumpers 125 that are in FIG. 3, which as depicted are attached to sides of the payload container. At least one HTE 110 is configured to be positioned adjacent to the first face of the payload container 120 when the payload container and the HTE are positioned within the SC. In FIG. 3, the HTEs adjacent to the first face of the payload container are elements 110 above the payload container 120. In the depicted embodiments, a first horizontal spacing element 115 (above the payload container) is configured to space at least one HTE from another HTE on the same side of the payload container, while allowing air to contact and flow across the HTEs; and a second horizontal spacing element (115 below the payload container) is configured to be positioned adjacent to the second face of the payload container (i.e., on the opposite side of the payload container from the first spacing element).

As with other embodiments herein, the present embodiments may include at least one additional HTE that is configured to be positioned adjacent to the second face of the payload container, on an opposite side of the payload container from the other HTE(s).

The payload containers in these embodiments, as with previously described embodiments, may be spaced from inside sidewalls of the SC using supports selected from the group consisting of: supports are part of, attached to or are connected to the payload container (see e.g., 125 of FIG. 1); supports that are part of, attached to or are connected to the SC (see e.g., 225 in FIG. 6, and 320 in FIG. 7); supports that are part of, attached to or or connected to the HTE and supports independent of the payload container, the SC and or the HTE.

The present systems may further include the SCs themselves.

The present inventors have discovered that an independent structure may be used to define a vertical air space, which reduces manufacturing costs and results in improved design stability, design flexibility and vertical air space consistency in all orientations and at all stages of HTE phasing. The present inventors named the independent vertical spacing structure a "shuttle".

Non-limiting example embodiments of the present systems may include a containment sleeve configured to be positioned around and spaced from the payload container, and is further configured to allow airflow between inside walls of the SC and outer walls of the containment sleeve.

Contemplating buoyant fluid at the boundary layer on the interior surface of an SC, and contemplating buoyant fluid convecting upwards, the present inventors made the following discovery: a partition or manifold structure defining a vertical air space between a cavity defined by the interior surface of an SC and a cavity defined by the exterior surface of a partition or manifold structure will organize and direct convecting fluids to exhaust ports at optimal locations in proximity to HTEs within a cooler structure and improve system performance.

The present inventors named the independent vertical partition structure a "containment sleeve".

An example of a containment sleeve system may include the system components described above with respect to prior embodiments, and a containment sleeve 135 (See FIG. 5), which may include spacers therein or thereon to space the containment sleeve from inside walls of a SC.

A containment sleeve may include at least one containment manifold which includes at least one band of rigid, semi-rigid or flexible material including for example a corrugated material that has been configured and arranged such the containment manifold is substantially hollow and lines significantly all the surface of the interior walls of an SC and whereon at least one edge of the containment manifold may be scalloped with at least one exhaust port. In an example embodiment of a containment sleeve, at least one Bumper may be arranged and configured on at least one surface of a containment manifold such that at least one bumper traps, spaces, suspends and supports at least one containment manifold from the surface of the interior walls of an SC. In another embodiment of a containment sleeve, at least one Bumper is arranged and configured on at least one interior surface of an SC, such that at least one Bumper traps, spaces, suspends and supports at least one containment manifold from the surface of the interior walls of an SC. Arranged and configured in this manner significantly all the vertical exterior surface of at least one containment manifold and significantly all the vertical interior surface of an SC are in fluid communication with air such that buoyant fluid at the boundary layer of the vertical interior surface of an SC may be significantly contained and exhausted through at least one Exhaust Port arranged and configured on at least one edge of at least one containment sleeve.

An example embodiment of at least one containment sleeve includes at least one containment manifold that has been assembled into a partition or that has been scored, folded and glued or mechanically fastened such that the containment manifold forms a substantially hollow structure whereon at least one edge is a dentiled or scalloped with at least one Exhaust Port and is open at the top and bottom, and whereon at least one Bumper is arranged and configured to its exterior surface. In another example embodiment at least one containment sleeve includes at least one containment manifold that has been assembled into a partition or that has been scored, folded and glued or mechanically fastened such that the containment manifold forms a substantially hollow structure whereon at least one edge is a dentiled or scalloped with at least one Exhaust Port and is open at the top and bottom. In another example embodiment, a containment sleeve or sleeve includes at least one containment manifold forms a substantially hollow structure whereon at least one edge is a detailed or scalloped with at least one Exhaust Port and is open at the top and bottom and whereon a three-dimensional waffled, ridged, corrugated, finned or convoluted pattern is arranged and configured such that air may move freely through the architecture of the peaks and valleys in the dimensioned pattern. In another example embodiment, a containment sleeve is formed with at least one Fluid-Filled Bladder the depth dimension of which may be regulated by the degree of pressure introduced therein.

A containment sleeve Cooler may be constructed using an SC Base into which a containment sleeve is placed. The cooler may be closed for example, using an SC Lid, and may be further sealed (e.g., using tape), as with other embodiments herein.

The inventors also made the discovery that interior volume and interior height available within an SC for the placement of HTEs, shuttles and payload containers may be adjusted with the attachment of a plurality of bases and lids of various depths to a collar of a fixed depth that defines both a payload container cavity and a HTE cavity.

Figure 5:
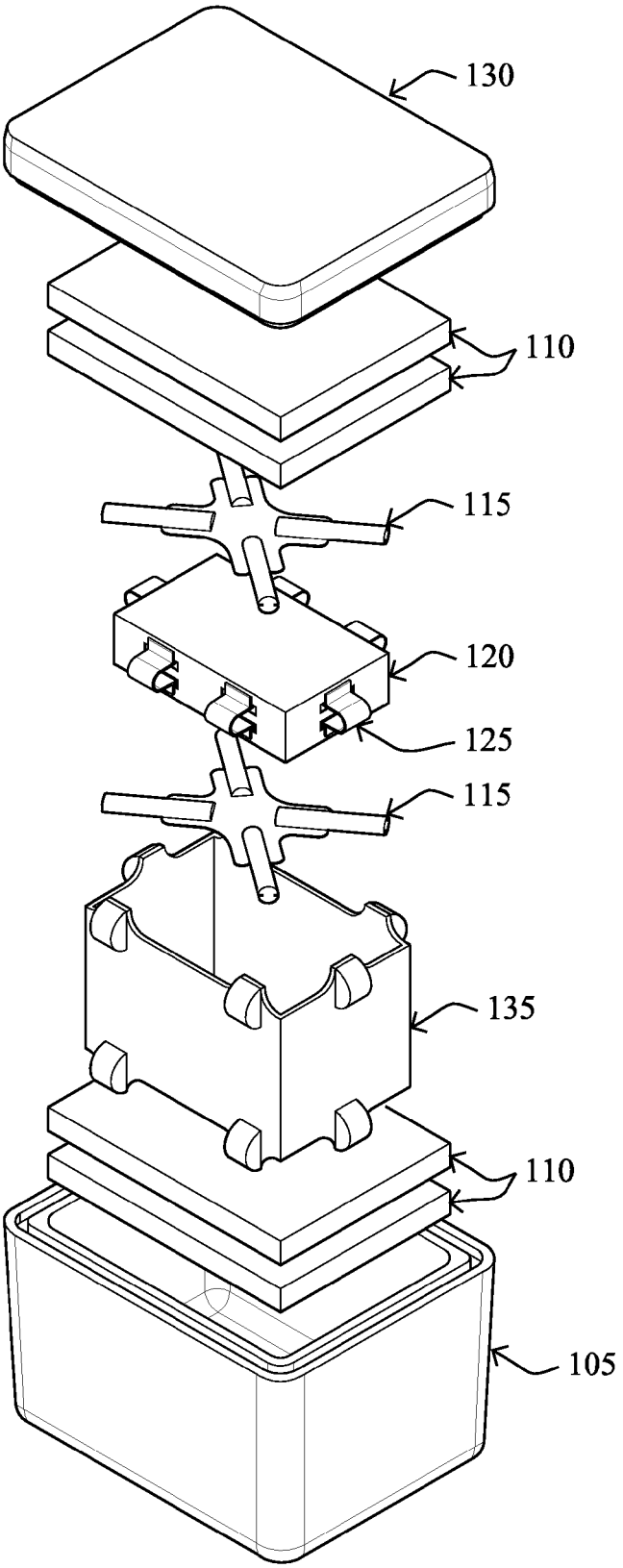
FIG. 5 depicts an exploded perspective view depicting non-limiting embodiments of a system according to example embodiments of the present invention, in which a containment sleeve is used to further separate the payload container from inside walls of the SC and to allow further regions of airflow.

As depicted in FIG. 5, the HTEs may be contained on and/or under the containment sleeve. In such embodiments, it may not be necessary to include horizontal spacers, as the design of the containment sleeve may serve to space the payload container from the HTEs, particularly, if it is possible to suspend or lock or attach the payload container to a desired location within the containment sleeve, such that support is not required (by the horizontal spacers).

Figure 6:
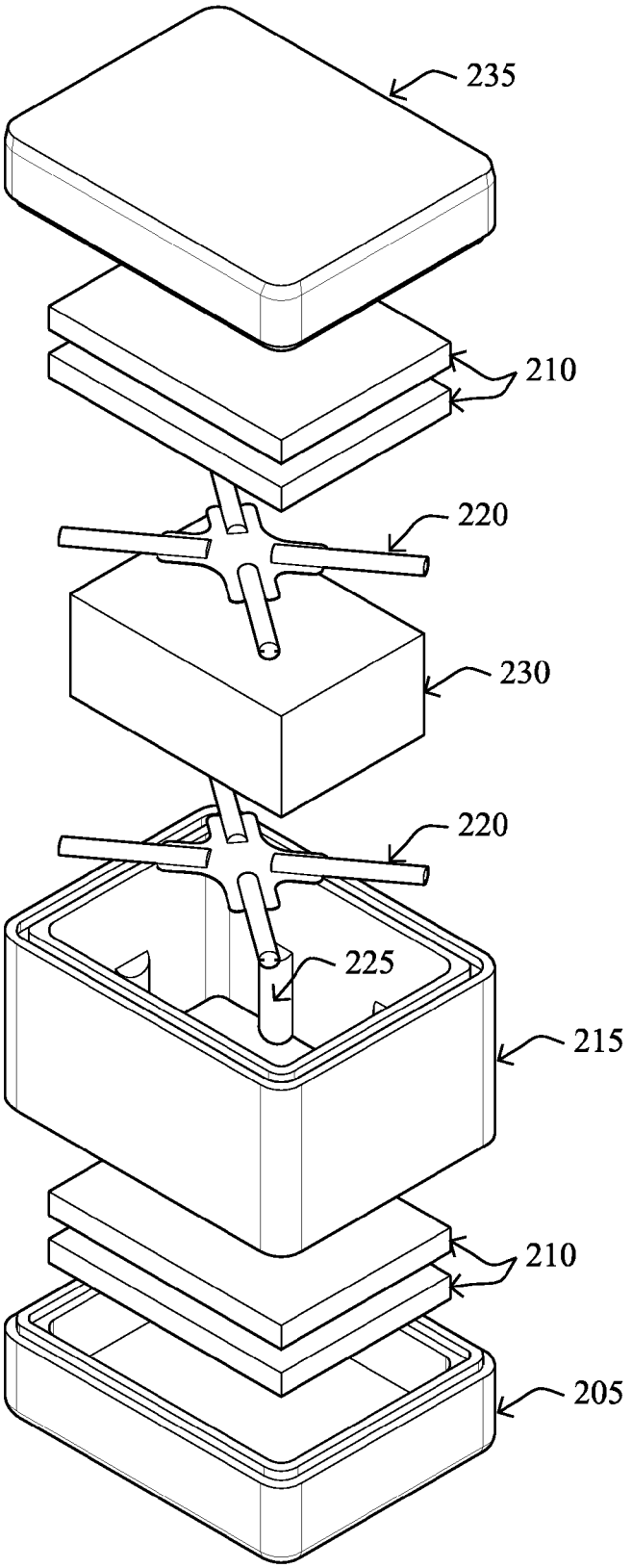
FIG. 6 depicts an exploded perspective view of non-limiting embodiments of a system according to example embodiments of the present invention in which the SC is a multipart modular container having supports for spacing the payload container from the SC, attached to or part of a portion of the SC itself.

According to non-limiting example embodiments, systems in accordance with the present invention may be based on the SC being a modular system, as depicted for example in FIGS. 6 and 7. According to the example embodiments, the SC is a multipart modular SC.

In non-limiting example embodiments, at least one of the spacers between the payload container and the sidewalls of the SC may be part of or attached to the SC (see e.g. spacers 225 in FIGS. 6 and 320 in FIG. 7).

FIG. 6 depicts a non-limiting example of a system employing a multipart modular container system having a base 205, a mid section 215 and a lid 235. The internal components may be included in various configurations as described throughout the various embodiments herein. The embodiment depicted in FIG. 6 includes lower HTEs 210, a shuttle 220, a payload container 230, a shuttle 220, and upper HTEs 210. The multipart systems however may have for example, the shuttles and spacers switched with HTEs (e.g., winter configurations) and/or spacers between HTEs (vented configurations), and any of the spacers/shuttles discussed herein.

According to further embodiments, at least one of the horizontal spacing elements is part of the multipart modular SC. (See e.g., 325 in FIG. 7).

In an alternative embodiment, the supports/spacers are not attached to either the SC or part thereof. In these embodiments, the spacers and supports may be part of either or both the HTE or the payload container itself. And in yet another embodiment, the supports may be independent of any other part of the container system and simply placed into the container system according to the particular design of the shipper. The spacers and supports may be made of insulating or non-insulating materials and/or as otherwise described herein.

Also included herein are universal payload collar pack embodiments. An example embodiment of embodiments of the present invention, which the present inventors named a "Universal Payload collar Pack" or "Universal collar Pack" is depicted in FIG. 7.

By way of non-limiting example, part of the modular system may include a base in a Universal Base/Lid that has a cooperative joint that forms an interference fit with one another. Vertical spacers may be for example, approximately half the depth dimension of at least one Payload container. Horizontal spacers may be arranged and configured to trap, space, suspend and support at least one Payload container and at least one HTE such that significantly all the surface area of at least one Payload container and at least one HTE are in fluid communication with air.

These embodiments may include using a base and lid (305 and 335 in FIG. 7) into which at least one lower HTE 310 may be placed. At least one universal collar 315 may be fit to the Base 305. At least one lower horizontal spacer may be placed on top of at least one HTE at the bottom of at least one universal collar 315. A Payload container 330 may be placed into at least one universal collar next to vertical spacers and on top of at least one horizontal spacer. At least one upper horizontal spacer is placed on top of at least one Payload container. A HTE is placed on top of at least one upper horizontal spacer. The container is closed with a Universal Base/Lid.

As discussed above, the vertical spacers between the payload container 330 and the inside walls of the SC (which may be inside walls of the collar), may be part of or attached to the inside walls of the SC (as shown at 320), or alternatively they may be part of or attached to the payload container, or they may be independent of both the payload container and the SC. Similarly, the horizontal spacers may be part of or attached to the SC/collar (as shown at 325 of FIG. 7), or alternatively they may be part of or attached to the payload container, or they may be independent of both the payload container and the SC.

In alternative embodiments having multipart modular SCs, the inventors envision that the at least one HTE may be configured directly adjacent to the payload container, with a horizontal spacer on an opposite side of the HTE from the payload container.

The embodiments depicted for example in FIG. 7, include a SC that includes a base 305, at least two Universal Payload Collars 315 and a lid 335. The Universal Payload collar 315 has a cooperative joint that forms an interference fit with the Base/Lid (305/335) on one open end and a cooperative joint that forms an interference fit with a second Universal Payload collar 315 on the opposite open end. As indicated above, a Universal Payload collar 315 may have for example horizontal spacers 325 arranged and configured on its interior to space at least one payload container 330 within a Universal Payload collar 315 such that significantly all the surface area of at least one payload container 330 is in fluid communication with air. At least one Universal Payload collar 315 also has for example, vertical spacers 320 arranged and configured on its sidewalls to trap, space, suspend and support at least one Payload container 330 and at least one HTE 310 such that significantly all the surface area of at least one Payload container 330 and at least one HTE 310 are in fluid communication with air.

A Universal Payload collar system may include for example a Base/Lid 305/335 into which at least one HTE 310 may be placed. A lower Universal Payload collar 315 may be fit to the Universal Base/Lid 305/315, which may trap at least one HTE 310. According to these embodiments, at least one payload container 330 may be placed into a Universal Payload collar 315 over at least one horizontal spacer 325 and next to at least one vertical spacer 320 such that there is an air space between at least one HTE 310 and at least one payload container 330 and such that there is an air space between at least one payload container 330 and at least one Universal Payload collar 315. An upper Universal Payload collar 315 may be fit to a lower Universal Payload collar 315 trapping at least one payload container 330 within the cavity defined by a lower Universal Payload collar 315 and upper Universal Payload collar 315 and at least one horizontal spacer 325 and at least one vertical spacer 320. An upper THE 310 may be placed over (adjacent to) at least one vertical spacer such that at least one HTE 310 and at least one payload container 330 are in fluid communication with air. The container may then be closed with an upper lid 335.

Components 315 in FIG. 7 show two halves of the cooperating fit of a middle portion of the SC/collars 315. The cooperating fit in this preferred embodiment is designed such that each half may include a tongue and groove joint that fits the tongue and groove joint of the other half, creating a substantially sealed fit to minimize air leakage and heat transfer with the external environment.

As shown in FIG. 7, one possible alternative is to provide a spacer 325 as part of a modular SC, which may support rigid or non-rigid HTEs and suspends the HTE from (e.g., above) the payload container without substantially compromising the amount of HTE surface area exposed to the air filled space between the payload container and HTE. The spacers/supports are not limited to a particular number, size, or type of material, but the supports may be arranged so as to maintain a configuration in which substantial amounts of a HTE's surface area is exposed to the air filled space.

As used herein, the term "cooperating fit" for example in the case of certain embodiments of multipart, modular systems, refers to the junction of two components, wherein the design of the components is made such that an area of one component comes in substantially solid contact with the junction area of a second component. Non-limiting examples of a cooperating fit may include for example, a tongue and groove junction and may also refer to a junction in which the surface area of the junction of the two components is substantially flat. It should also be understood, that any of the embodiments set forth herein, including non-modular systems e.g., having a base and a lid and any other type of SC may similarly employ a cooperating fit between SC parts, for example between bases, lids and/or collars.

The cooperating fit results in a substantially sealed container system protecting the payload from external temperatures. While the assembled base container, payload, HTE collar, and lid may be shipped as assembled, the components are preferably placed inside a closure carton such that the closure carton substantially surrounds the assembled components.

In the embodiments depicted in FIG. 7, a portion of the modular SC includes "L" shaped supports or spacers 325, which may be configured to space the payload container from the HTE. The width, location, and shape of the supports 325 may be configured to minimize contact with the HTE (not shown), while providing stability and physical support to the HTE. The supports 325 may also be designed to suspend the HTE above the payload 330 to create an air filled space between the HTE 310 and payload 330. By ensuring that the surface area of the HTE exposed to the air is substantial, the design maximizes the use of heat transfer principles to efficiently maintain a desired temperature range.

The system depicted in FIG. 7 includes air filled space created by the vertical spacers 320 between the SC sidewalls and payload container 330 after insertion of the payload container into the SC 315.

The components of the present embodiments, such as components of the multipart modular SC, may each be made for example of a single molded part made of expanded polystyrene or other insulating material such as polyurethane. In example embodiments, when assembled the components form a six-sided orthogonal insulated container.

Also included herewith are embodiments that include a universal payload collar pack.

It should be understood that the present inventions are intended to include the individual components that make up the present systems, combinations of the inner components (with and without the outer shipping container or container), and the overall systems, with and without the payload therein. Further provided are any and/or all of the systems described herein including a SC and/or portion of a SC (for example, the SC and components therein may not necessarily include a lid, to be added at a later time). Further provided are any and/or all of the systems described herein including any payload that may already be included in the payload container and/or has not yet been placed in the payload container. Also encompassed hereby are kits that include various components of the present systems, and methods of assembling the various systems, as described above and set forth below Further provided herein are kits that include one or more of the components set forth herein. By way of non-limiting example, kits provided herein may include one or more of the following: a payload container having at least a first face, and a second face on an opposite side of the payload container from said first face, in which the payload container is configured to be positioned within and spaced from inside sidewalls of a SC; at least one HTE, which may be configured to be positioned adjacent to the first face of the payload container when positioned within a SC; a first horizontal spacing element, which may be configured to space the at least one HTE from the first surface of the payload container, from a second HTE adjacent to the payload container, or from an inside top surface of the SC. The spacing element may be configured for example so as to allow air space and air flow across and between the surfaces that it spaces. Example kits may include a second horizontal spacing element, which may be configured to be positioned adjacent to the second face of the payload container.

Non-limiting example kits may also include for example, a SC. The SC may be configured to receive therein a payload container, at least one HTE; a first horizontal spacing element, and a second horizontal spacing element, and optionally further components as described herein.

Further non-limiting example kits may also include for example, a multipart modular SC. The SC may be configured to receive therein a payload container and at least one HTE, and optionally further components as described herein. A first horizontal spacing element, and a second horizontal spacing element in such embodiments may be included as part of the SC itself or as attachments thereto.

Further example kits may include for example instructions e.g., for configuring, assembling and/or packing SCs with the system elements. Further example kits may include any implement that may be used in assisting with packing or assembling the SCs, e.g. a rack as set forth below or other tools that may be apparent to those skilled in the art.

Also provided herein are methods of assembling a SC, by positioning any of the components set forth herein within a SC, for example as described above. By way of non-limiting example, example methods may include positioning a payload container within a SC, wherein the payload container is spaced from inside sidewalls of a SC; and wherein the payload container includes at least a first face and a second face on an opposite side of the payload container from the first face; and positioning the HTE(s) adjacent to the first face of the payload container within said SC; wherein the HTE(s) may be configured for spacing the at least one HTE from the first surface of the payload container, from a second or more HTE, and/or from an inside top surface of the SC. Example methods may also include positioning a first horizontal spacing element within a SC, the spacing element being configured and placed so as to allow air space and air flow across and between surfaces that it spaces; the first horizontal spacing element being configured to space the HTE(s) from at least one element selected from the first surface of the payload container; from a second HTE adjacent to the payload container, and from an inside top surface of the SC; where the spacing element is configured so as to allow air space and air flow across and between the surfaces that it spaces. The methods may further include positioning a second horizontal spacing element in the SC, which is configured to be positioned adjacent to the second face of the payload container.

In example methods, the at least one HTE comprises two or more HTEs, and the second spacing element is packed between HTEs.

Example methods may further include positioning at least one HTE into the SC adjacent to the second side of the payload container (for example under the payload container).

According to non-limiting examples, the SC may be a modular SC, which already includes or has attached thereto, one or more element, such as the spacing elements as parts thereof.

Also disclosed are methods of shipping temperature sensitive goods and products according to the container system disclosed herein. As distribution costs rise, shippers are constantly faced with increasing the efficiency and effectiveness of their distribution systems. To that end, the container systems disclosed herein can be effectively used in a distribution system to reduce labor, material, and construction costs. According to one aspect of the container system, a method wherein the HTE is pre-packed may be employed whereby the HTE is packed e.g., into a HTE collar prior to assembly or packaging of the base container. According to this method, and depending on the specific requirements of a shipper, a variety of HTEs may be packed and readily available for selection by a shipper. At the time of shipping, the assembler may make determinations about the type of HTE needs depending on the estimated length of shipment, the temperature requirements of the payload, and/or other factors. At that time, the shipper may select the pre-packed HTE collar to meet its shipping requirements. Accordingly, at the time of shipping, automated or non-automated systems may be used to select HTE collars according to certain parameters, such as phasing temperature, size, etc., specifically for the payload being shipped. This method provides a shipper with a great degree of flexibility when packing container systems by allowing it to specifically tailor each shipped container system.

Alternatively, according to example embodiments, one packing the present SCs, such as a shipper, may pre-pack base containers (e.g., component 105). In such embodiments, the base containers may be packed for example with a spacer, or a spacer and their payloads/payload containers in a separate facility or at a time prior to final assembly of the container system. This would allow, for example, a shipper to pre-pack the base container under refrigerated conditions at a separate location. When desired, one or more of the pre-packed base containers may be moved to a different location to have the container system finished prior to shipping. Thus, example methods herein may include only a portion of the assembly, or the entire assembly process of a SC.

Example embodiments of methods may include a unique packing method called a "stack out" method. In such embodiments, the various components may be layered into a SC, such as a cooler, rather than being fit and wrapped and placed in the SC. This may advantageously allow for a robotic pack-out. Such methods/systems may advantageously increase pack-out speed and reduce operator error.

Further methods herein may include possible side-loading methods and clamshell packing methods. According to non-limiting example embodiments at least one HTE, at least one horizontal spacer (e.g., shuttle) and at least one payload container may be loaded into a SC from the side.

A side loading clamshell pack may include for example, SC halves that may for example be identical (although they do not necessarily have to be identical). A single tool that makes one half and two halves make the pack. In another example embodiment of the Side-Loading Clamshell Pack, horizontal bumpers may be molded into the SC halves and the Payload container may have for example no Bumpers mounted to it.

The Side-Loading Clamshell Pack may be assembled for example by a method that includes by placing, from left to right for example, at least one "lower" HTE, at least one lower spacer/shuttle, at least one Payload container into a half of the SC. The system may be closed with an identical "upper" SC half placed over a lower SC Half. It should be understood that they payload container may be included in either of the SC halves as part of the loading and assembly process.

As with other embodiments, in these embodiments, the elements may be placed individually into portions of the SC, or they may be grouped together prior to being placed into the SCs. For example, the lower HTE(s) and lower spacer shuttle may be held together and inserted into half of the SC together, so long as the final placement and configuration of the elements within the container is in a desired configuration.

Also encompassed by the present invention is a Spacer Rack Pack Embodiment. By way of example, at least one horizontal spacer and at least one bumper may be integrated into at least one rack system that is loaded outside of a SC and then placed into a shipping container. The Spacer Rack Pack may include for example at least one rack with at least one shelf that allows air to flow through it. At least one shelf may be arranged and configured to trap, space, suspend and support any of the above components of the present systems in any of the configurations set forth or contemplated herein. By way of example, the shelf may be configured to support at least one lower HTE, at least one payload container and at least one upper HTE. At least one bumper may be integrated into the rack standards or posts such that at least one Payload container and at least one HTE are in fluid communication with air.

In example embodiments, the Spacer Rack System may be constructed using at least one rack into which at least one lower HTE, at least one payload container, and at least one upper HTE are placed. At least one loaded rack is then placed into an SC base and the container is closed with an SC Lid.

Further provided herein are products that include any one or more of the herein described components and/or an entire SC having one or more of the described components therein. By way of non-limiting example, the present invention includes the shuttles described herein, as well as SCs containing such shuttles and other components. Also provided are SCs or portions thereof prepared or assembled by the methods provided herein.

The above and following examples and accompanying figures are provided to illustrate various non-limiting embodiments of the present inventions. It should be understood that these examples are meant to be illustrative and do not limit the scope of any claims submitted hereinafter. As may be apparent to skilled artisans, many variations and modifications are intended to be encompassed within the spirit and scope of the inventions. For example, it should be understood that certain components of the present systems and methods may be pre-fit together or assembled in a different order than that specifically described herein and still form essentially the same configuration of components.

EXAMPLE

Example 1—Active Bumper Pack Embodiment

An example of an Active Bumper Pack embodiment as depicted in FIG. 1 may be provided according to non-limiting example embodiments, which includes an Insulated SC (SC) base 105 and an SC Lid 130. At least one payload box 120 is provided having bumpers 125 arranged and configured on its surface. These systems include two cross member type shuttles 115 (although other spacers or shuttles are contemplated as set forth herein), arranged in direct contact with the payload container 120 and configured to trap, space, suspend and support at least one payload container 120, which may or may not already have a payload positioned therein. Two HTEs 110 may be positioned adjacent to each of opposite sides of the payload container, but spaced from the payload container by the shuttles 115, such that at least one Payload container 120 and at least one HTE 110 on either side of the container are in fluid communication with air.

The Payload container Bumper Pack may be assembled by the following example method. At least one lower HTE 110 (under the payload container) may be placed into an SC base 105. At least one lower Shuttle 115 (under the payload container) is then placed on top of at least one lower HTE and a Payload container 120 with at least one bumper 125 arranged and configured on its side surfaces is placed on top of at least one lower shuttle 115 (under the payload container). At least one upper shuttle 115 is placed on top of at least one Payload container 120 and at least one HTE 110 is placed on top of at least one upper Shuttle 115 such that surfaces of at least one HTE 115 and at least one Payload container 120 are in fluid communication with air. The container 105 is closed with an SC Lid 130.

Although the inventions have been described in example embodiments, those skilled in the art will appreciate that various modifications may be made without departing from the spirit and scope of the invention. It is therefore to be understood that the inventions herein may be practiced other than as specifically described. Accordingly, it is intended that such changes and modifications fall within the scope of the present invention as defined by the claims appended hereto. Thus, the present embodiments should be considered in all respects as exemplary and illustrative and not restrictive.

We claim:

1. A system comprising:

a payload container having at least a first face, and a second face on an opposite side of the payload container from said first face, said payload container being configured in size and shape such that said payload container may be positioned within and spaced from inside sidewalls of an insulated shipping container, such that air is free to flow between outside sidewalls of the payload container and the inside sidewalls of the insulated shipping container;

a first horizontal spacing element in direct contact with the first face of the payload container and between and directly contacting and separating the payload container and at least one first heat transfer element such that said payload container and said first heat transfer element do not directly contact one another, said first horizontal spacing element being configured above the payload container to space the first face of the payload container from the at least one first heat transfer element, such that air flows freely between the first surface of the payload container and all surfaces of the first heat transfer element and a convection current is created across exposed surfaces of the at least one first heat transfer element; and a second horizontal spacing element positioned adjacent to the second face of the payload container, on an opposite side of the payload container from the first horizontal spacing element.

2. The system of claim 1, further comprising at least one second heat transfer element configured to be positioned facing the second face of the payload container below the payload container.

3. The system of claim 1, wherein the payload container is configured to be spaced away from inside sidewalls of the insulated shipping container using one or more supports selected from the group consisting of: supports that are part of, attached to, or connected to the payload container; supports that are part of, attached to, or connected to the shipping container; and supports independent of the payload container and of the shipping container.

4. The system of claim 1, further comprising the insulated shipping container.

5. The system of claim 1, further comprising a containment sleeve configured to be positioned around and spaced away from the payload container, and is further configured to allow airflow between inside walls of the shipping container and outer walls of the containment sleeve.

6. The system of claim 1, wherein the insulated shipping container is a multipart modular shipping container.

7. The system of claim 4, further comprising an outer shipping container and at least one outer heat transfer element, wherein the insulated shipping container of claim 4 is configured to be positioned within the outer shipping container in a position and configuration as a payload container.

8. The system of claim 6, wherein the at least one of the first horizontal spacing element and the second horizontal spacing element is part of or attached to at least one part of the multipart modular shipping container.

9. A system comprising:

a payload container having at least a first face, and a second face on an opposite side of the payload container from said first face, said payload container being configured in size and shape such that said payload container may be positioned within and spaced from inside sidewalls of an insulated shipping container, such that air is free to flow between outside sidewalls of the payload container and the inside sidewalls of the insulated shipping container;

a first horizontal spacing element positioned above the payload container, which directly contacts and spaces and directly separates at least one first heat transfer element from either: an inside top surface of the shipping container, or from a second heat transfer element wherein both of said first heat transfer element and said second heat transfer element are facing the first face of the payload container, wherein the first horizontal spacing element allows air to contact and flow freely across all surfaces of the at least one first heat transfer element and a convection current is created across exposed surfaces of the at least one first heat transfer element; and a second horizontal spacing element configured to be positioned adjacent to the second face of the payload container below said payload container, on an opposite side of the payload container from the first horizontal spacing element.

10. The system of claim 9, further comprising at least one additional heat transfer element configured to be positioned facing the second face of the payload container below the payload container.

11. The system of claim 9, wherein the payload container is configured to be spaced away from inside sidewalls of the insulated shipping container using one or more supports selected from the group consisting of: supports that are part of, attached to, or connected to the payload container; supports that are part of, attached to, or connected to the insulated shipping container; and supports independent of the payload container and of the insulated shipping container.

12. The system of claim 9, further comprising the insulated shipping container.

13. The system of claim 12, further comprising an outer shipping container and at least one outer heat transfer element, wherein the insulated shipping container of claim 12 is configured to be positioned within the outer shipping container position is a position and configuration as a payload container.

14. The system of claim 9, further comprising a containment sleeve configured to be positioned around and spaced from the payload container, and is further configured to allow airflow between inside walls of the shipping container and outer walls of the containment sleeve.

15. The system of claim 9, wherein the shipping container is a multipart modular shipping container.

16. The system of claim 9, wherein the at least one of the first horizontal spacing element and the second horizontal spacing element is part of or attached to at least one part of the multipart modular shipping container.

17. A kit comprising:

a payload container having at least a first face, and a second face on an opposite side of the payload container from said first face, said payload container being configured in size and shape such that said payload container may be positioned within and spaced from inside sidewalls of an insulated shipping container, such that air is free to flow between outside sidewalls of the payload container and the inside sidewalls of the insulated shipping container;

a first horizontal spacing element configured to directly contact at least one first heat transfer element and to space and directly separate the at least one first heat transfer element from at least one element selected from the group consisting of: the first face of the payload container such that said payload container and said first heat transfer element do not directly contact one another such that air is free to flow between the payload container and all surfaces of the first heat transfer element; a second heat transfer element facing to the payload container; and an inside top surface of the shipping container; said first horizontal spacing element being configured above the payload container such that air is free to flow across and between the surfaces that said first horizontal spacing element spaces, whereby a convection current is created across exposed surfaces of the at least one first heat transfer element; and a second horizontal spacing element configured to be positioned adjacent to the second face of the payload container, on an opposite side of the payload container from the first horizontal spacing element.

18. The kit of claim 17, further comprising the shipping container configured to receive therein the payload container, the at least one heat transfer element; the first horizontal spacing element, and the second horizontal spacing element.

19. The kit of claim 17, further comprising the shipping container, wherein said shipping container comprises a multipart modular shipping container comprising the first horizontal spacing element as either part of the shipping container or as an attachment thereto; and wherein said shipping container is configured to receive the payload container and the at least one heat transfer element therein.

20. A method of packing an insulated shipping container comprising:

positioning a payload container within said shipping container, such that said payload container is spaced from inside sidewalls of said shipping container; and wherein said payload container comprises at least a first face and a second face on an opposite side of the payload container from said first face, such that air is free to flow between outside sidewalls of the payload container and the inside sidewalls of the insulated shipping container;

positioning at least one first heat transfer element such that said first heat transfer element faces the first face of the payload container, within said shipping container; a first horizontal spacing element being in direct contact with the at least one first heat transfer element and being configured above the payload container for spacing by directly separating the at least one first heat transfer element from at least one element selected from the group consisting of: the first face of the payload container such that said payload container and said first heat transfer element do not directly contact one another and air flows freely between the payload container and all surfaces of the first heat transfer element; a second heat transfer element positioned facing to the first face of the payload container; and an inside top surface of the shipping container, and a convection current is created across exposed surfaces of the at least one first heat transfer element;

wherein the first horizontal spacing element is configured so as to allow air space and air flow across and between surfaces that the first horizontal spacing element spaces; and positioning a second horizontal spacing element adjacent to the second face of the payload container, on an opposite side of the payload container from the first horizontal spacing element.

21. The method of claim 20, wherein the at least one first heat transfer element comprises two or more heat transfer elements, and the second horizontal spacing element is packed between heat transfer elements.

22. The method of claim 20, further comprising positioning at least one additional heat transfer element within the shipping container facing the second face of the payload container.

23. The method of claim 20, wherein the shipping container is a modular shipping container comprising the first horizontal spacing element and the second horizontal spacing element as parts of the modular shipping container.

* * * * *